US005735515A

United States Patent [19]

Hayashi et al.

[11] Patent Number: 5,735,515

[45] Date of Patent: Apr. 7, 1998

[54] SHEET HANDLING APPARATUS WITH FOLDED AND NON-FOLDED SHEET TRANSFER SPEEDS

[75] Inventors: Kenichi Hayashi; Masaaki Sato, both of Kawasaki, Japan

[73] Assignee: Canon Kabushiki Kaisha, Tokyo, Japan

[21] Appl. No.: 625,293

[22] Filed: Apr. 1, 1996

[30] Foreign Application Priority Data

Mar. 31, 1995 [JP] Japan ..... 7-076137

[51] Int. Cl.[6] ..... B65H 39/02

[52] U.S. Cl. ..... 270/58.11; 270/58.14; 270/58.18

[58] Field of Search ..... 270/32, 45, 51, 270/58.07, 58.08, 58.09, 58.11, 58.14, 58.18

[56] References Cited

U.S. PATENT DOCUMENTS 4,479,640 10/1984 Smith ..... 270/32
4,616,815 10/1986 Vijuk ..... 270/45
4,898,570 2/1990 Luperti et al. ..... 270/45 X
5,082,255 1/1992 Brigante et al. ..... 270/45
5,102,111 4/1992 Reponty ..... 270/51 X
5,449,157 9/1995 Kawano et al. ..... 270/58.11

*Primary Examiner*—Hoang Nguyen
*Attorney, Agent, or Firm*—Fitzpatrick, Cella, Harper & Scinto

[57] ABSTRACT

A sheet processing apparatus includes a tray for stacking a folded or non-folded sheet; a stacker for receiving the folded sheet or non-folded sheet from the tray to stack it thereon; a transfer device for transferring the folded sheet or non-folded sheet from the tray to the stacker; and controller for controlling speed of the transferring device so as to satisfy:

$$V1<V2$$

where V1 is a transfer speed for the folded sheet, and V2 is a transfer speed of the non-folded sheet.

16 Claims, 34 Drawing Sheets

RELAED ART

RELAED ART

SHEET HANDLING APPARATUS WITH FOLDED AND NON-FOLDED SHEET TRANSFER SPEEDS

FIELD OF THE INVENTION AND RELATED ART

The present invention relates to a sheet processing apparatus equipped with a sheet set transferring means, more specifically, a sheet procesing apparatus, which selectively sorts, folds, and/or binds the sheets sequentially discharged one by one from an image forming apparatus, for example, and stacks the processed sheets or sheet sets; or a sheet processing apparatus, which selectively carries out the like processes.

As for a conventional sheet processing apparatus, one disclosed in U.S. Pat. No. 5,217,215 has been known.

Referring to FIG. 41, the sheet procssing apparatus disclosed in Japanese Lad-Open Patent Application No. 138, 291/1992 comprises: a sorter 302 for sorting the sheets discharged from the main assembly 301 of an image forming apparatus into two or more bins 302*b*; a stapler 302*d* for stapling the sheets having been sorted into each bin; a sheet stocking portion 305 disposed between the image forming apparatus main assembly 301 and the sorter 302 ;a sheet delivery path through which the sheets are delivered from the image forming apparatus main assembly 301 to the sorter 302; discharging means for discharging the sheets from the bin 302*b* to the stocking portion 305; and vertically moving means for moving each bin to the discharging means 306. The sheets having been sorted into each bin of the sorter are stapled, and discharged to the stocking portion 305.

Referring to FIG. 42, the sheet processing apparatus disclosed in Japanese Laid-Open Patent No. 156,392/1992 comprises: a sorting portion 307 which sorts and stores the sheets discharged from an image forming apparatus; a sheet delivery path 309 disposed between the sheet discharging portion 308 of the image forming apparatus and the sorting portion 307; a stapler 310 for stapling the sheet sets having been stored in the sorting portion 307; and a stacker portion 311 which is disposed below the sheet delivery path 309, and stores the stapled sheet sets.

Both the sheet processing apparatuses described above are enabled to process more sheet sets than the number of bins by transferring the sheet sets from the sorting portion to the stacking portion which is independent from the sorting portion.

In recent years, the image forming apparatus has come to be more diversely used, and consequently, demand has been increasing for an image forming apparatus capable of accommodating such diverse usage. For example, one of the image forming apparatuses capable of satisfying such demands can accommodate an original set consisting of sheets having different sizes of the same sheet size measurement system, by being provided with a folding device. This folding device is known to be capable of folding a large size sheet (A3, B4) to match a smaller size (A4, B5) of the same sheet size measurement system. The detailed description of this folding device will be not be given at this time.

However, when attempts were made to combine a folding apparatus such as the one described above with a conventional sheet processing apparatus such as the one described above, the following problems became apparent.

When the sheet set containing the sheets folded by the above folding device was transferred from the sorting portion to the stacking portion, the folded portion of he sheet became unfolded due to the shock generated during the transfer, hindering the process for stacking the sheet sets in the stacking portion.

SUMMARY OF THE INVENTION

Accordingly, a primary object of the present invention is to provide a sheet processing apparatus capable of transferring a sheet set containing folded sheets, without disturbing the alignment of the sheets in the sheet set.

According to an aspect of the present invention, a sheet processing apparatus in accordance with the present invention comprises: sheet transferring means for transferring a folded sheet or a flat sheet (sheet which has not been folded): and controlling means for controlling the sheet transferring means so that the relationship between a sheet transferring speed V1 at which the folded sheet is transferred, and a sheet transferring speed V2 at which the flat sheet is transferred, satisfies he following formula:

$$V1<V2.$$

According to another aspect of the present invention, the sheet transferring means is controlled by the controlling means so that the acceleration and the deceleration of the sheet transferring means in a folding mode becomes slower than those in a non-folding mode.

According to another aspect of the present invention, the sheet transferring means is controlled by the controlling means so that when sheet set having a flat sheet as the uppermost sheet is transferred, the speed at which the sheet set is transferred remains the same whether the folding device is in the folding mode or not, wherein whether the uppermost sheet of a sheet set is folded or not is detected by sheet state detecting means of the controlling means, which detects the state of the last sheet delivered.

With the provision of the above structure, when the folding device is in the folding mode, and a sheet set to be transferred contains a minimum of one folded sheet, the sheet transferring means is controlled by the controlling means so that the sheet set is transferred at a speed slower than the transfer speed for the non-folding mode.

With the employment of the above arrangement, sheet alignment is not disturbed even when a sheet set containing folded sheets is transferred. As a result, the sheet sets can be more preferably stacked by stacking means.

Further, the sheet transferring means is controlled by the controlling means so that when in the folding mode, a sheet set is transferred at a lower acceleration-deceleration speed than when in the non-folding mode. Therefore, the sheet alignment is not disturbed during the sheet set transfer, improving the process for stacking the sheet sets in the stacking portion.

Further, the sheet set transferring means is controlled by the sheet state detecting means of the controlling means, which detects the state of the sheet delivered last, so that when the uppermost sheet of a sheet set having been stored in a sheet receiving tray is not a folded sheet, the sheet set is transferred at the same speed whether in the folding mode or non-folding mode. As a result, a sheet set can be transferred at a higher speed even when in the folding mode.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Figure 1:
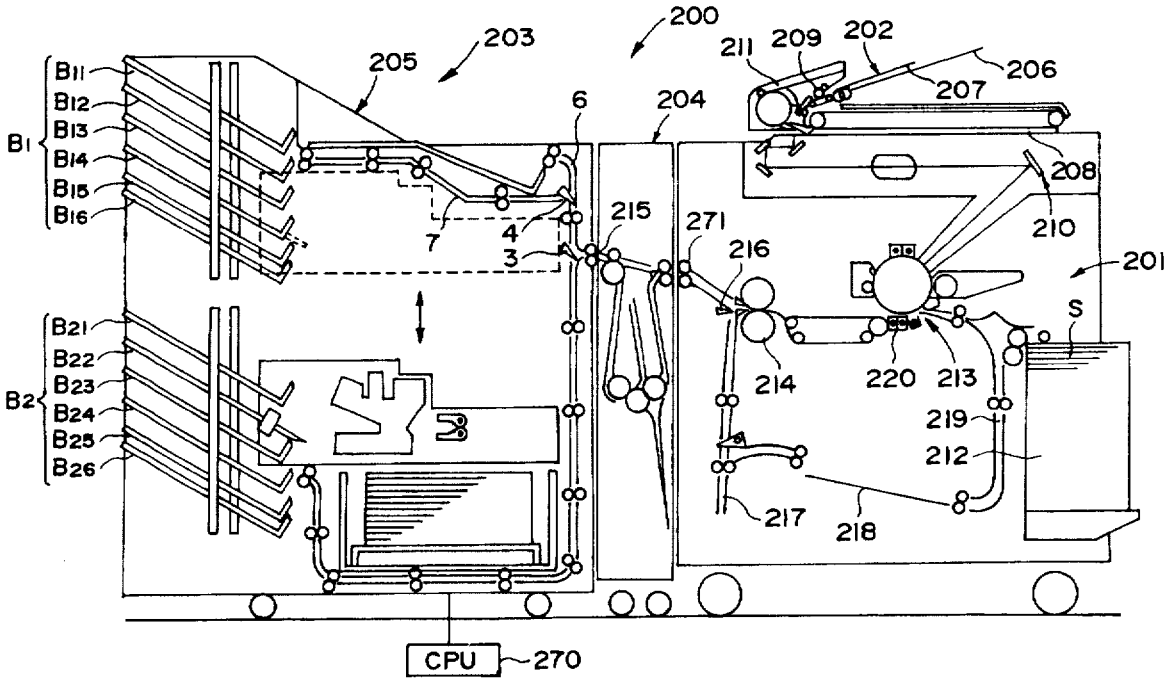
FIG. 1 is a combined longitudinal section, as seen from the front side, of a sheet processing apparatus in accordance with the present invention, and the main assembly of an image forming apparatus connected to the sheet processing apparatus.

FIG. 1 illustrates an electro-photographic copying machine 200 (image forming apparatus) as a sheet outputting apparatus.

The electro-photographic copying machine 200 comprises a copying machine main assembly 201 (hereinafter, main assembly), an automatic original circulating apparatus 202 disposed on the main assembly 201, and a post-image formation sheet processing apparatus 203 (hereinafter, sheet processing apparatus) connected to the main assembly, on the side from which a sheet S is discharged. The sheet processing apparatus 203 comprises a folding apparatus 204 and a stapling-stacking apparatus 205.

An original 207 is placed on he original table 206 of the automatic original circulating apparatus 202. Then, the sheets in the original 207 are sequentially separated from below, and delivered to the surface of the platen glass 208 of the main assembly 201 through a path 209. After being read by the optical system 210 of the main assembly 201, each sheet of the original is forwarded from the platen glass 207 through a path 211, and discharged onto the preceding sheet of the original having been accumulated on the original table 206. The sheet S is fed from a deck 212 to an image forming portion 213, in which an image is formed on the sheet S. Then, the sheet S with the image is sent to a fixing portion 214, in which the image is fixed to the sheet S. Next, this sheet S with the fixed image is delivered to the sheet entrance 215 of a stapling-stacking apparatus 205, through a folding apparatus 204 which normally is not activated.

The image forming process of this copying machine main assembly 200 is in the public domain: therefore, it will not be described at this time.

Figure 2:
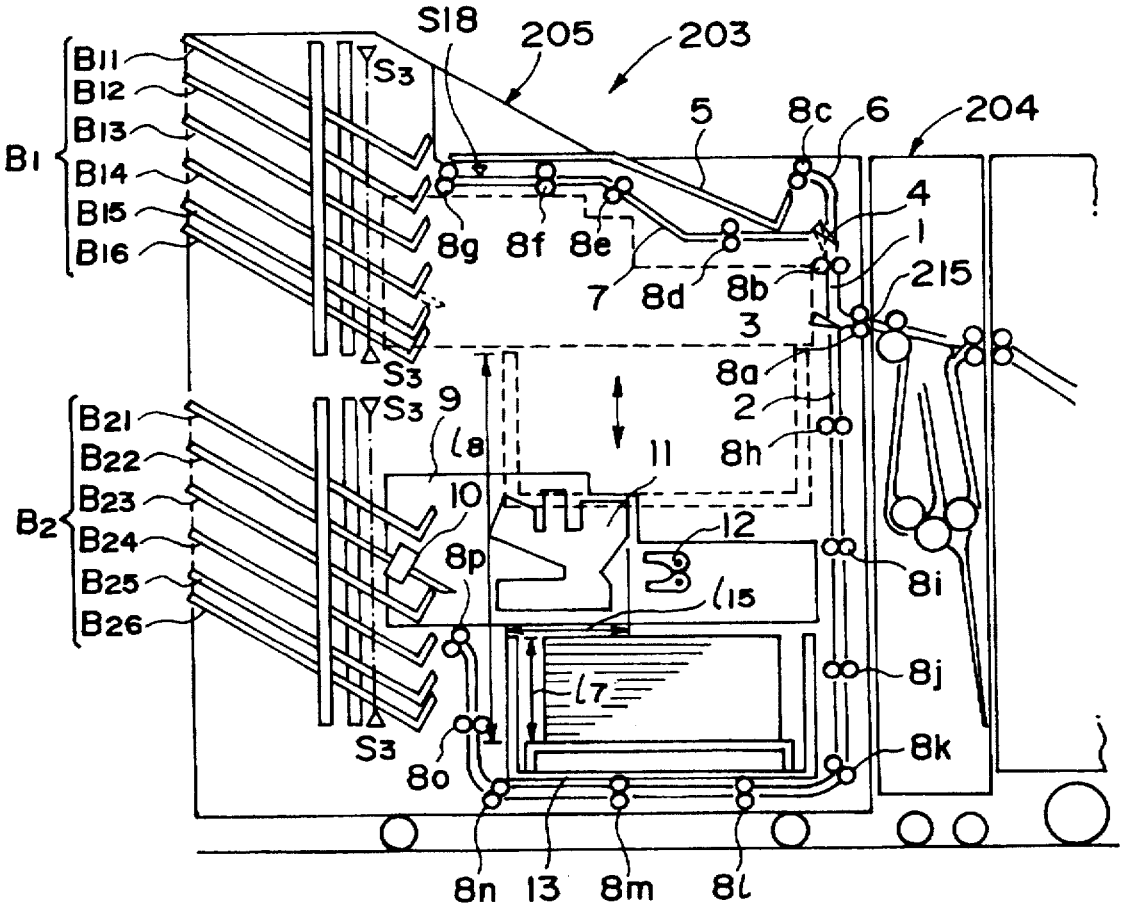
FIG. 2 is a longitudinal section, as seen from the front side, of the sheet processing apparatus in accordance with the present invention.

Referring to FIGS. 1 and 2 the stapling-stacking apparatus 205 comprises two bin modules B1 and B2. Bin modules B1 and B2 comprise bins (sheet catching tray) B1l–B1n, and B2l–B2n (in the drawing, n=6), respectively. The bin interval and the bin position in each bin module can be varied, independently of the other module, to move each bin to a sheet catching position or a sheet set discharging position.

The sheet entrance 215 is provided with a deflector 3, which is driven by an unillustrated solenoid switch SL3 to switch the sheet path between a first delivery path 1 (upward path) and a second delivery path 2 (downward path), determining thereby the direction in which the sheet S is advanced. The first delivery path 1 branches into a discharging path 6 leading to a non-sorting tray 5, and a path 7 leading to the upper module B1. The choice between the paths 6 and 7 is made by a deflector 4 driven by an unillustrated solenoid switch SL4.

On the other hand, the second delivery path 2 simply constitutes a path leading to the bottom module B2. Regarding roller pairs 8*a*–8*p*, the sheet delivery to the non-sorting tray 5 is handled by the roller pairs 8*a*, 8*b* and 8*c*: the sheet delivery to the upper module B1 is handled by the roller pairs 8*a*, 8*b* and 8*d*–8*g* and the sheet delivery to the bottom module B2 is handled by the roller pairs 8*a*, and 8*h*–8*p*.

The stapling-stacking apparatus 105 comprises a gripping-stapling unit 9, which is disposed in a space formed between the path to the upper module and the path to the bottom module. The gripping-stapling unit 9 moves the sheet set in each bin to the right of FIGS. 1 or 2 by a edge pick-up gripper 10, selectively staples it, and moves it further to the right by a transfer gripper 12 which grips the tip of the sheet set. Also in the space between the path to the upper module and the path to the bottom module, a stacking unit 13 is disposed, being on standby below the gripping-stapling unit 9 to store the sheet set transferred by the transfer gripper 12.

Referring to FIG. 2 the right end portion of the stapler 11 and the left end portion of the stacking unit 13 overlap in the horizontal direction (region correspondent to a width $\mathbf{1}_{15}$ in FIG. 2).

Referring to FIGS. 1 and 2, after each of the bins B11 and B16 of the upper module is filled with a sheet set, the sheet sets are picked out of the bins by the gripping-stapling unit 9 which is moved to a position indicated by the broken line meanwhile, the sheets are delivered to the bins B21–B26 of the bottom module. Then, after all the sheet sets in bins B11–B16 are removed and each of the bins B21–B25 of the bottom module is filled with a sheet set, the sheet sets are picked out of the bottom module by the gripping-stapling unit which this time is moved to the position indicated by the solid line in FIG. 1 or 2. This operation can be repeated until the stacking unit becomes full. In other words, copies can be continuously made until the stacking unit becomes full.

Figure 36:
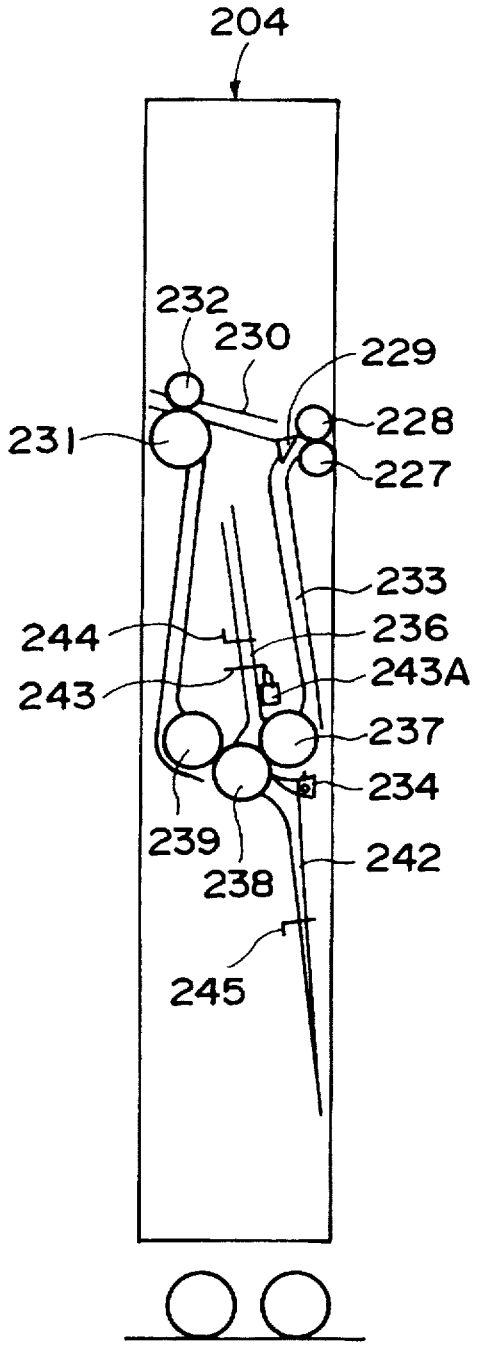
FIG. 36 is a front view of a folding apparatus of the bin module.

Next, referring to FIG. 36, the folding apparatus 204 will be described. This folding apparatus 204 can operate in three modes: a through path mode, Z-folding mode and C-folding mode.

The first mode, the through path mode, is a mode for allowing the sheet S to pas through the folding apparatus 204 without activating it. In this mode, the sheet 225 delivered inward by a pair of entrance rollers 227 and 228 is guided into a sheet path 230 by the activation of an entrance deflector 229, and then is discharged into the post-image formation sheet processing apparatus 203 by a pair of discharge rollers 231 and 232.

The second mode, the C-folding mode, is a mode for molding a LGL sheet 251 into the LTR size (lengthwise). In this mode, the sheet 251 guided into a sheet path 233 by the pair of entrance rollers 227 and 228 and the entrance deflector 229 is further guided into a folding path 236 by the activation of a deflector 234.

Figure 37A:
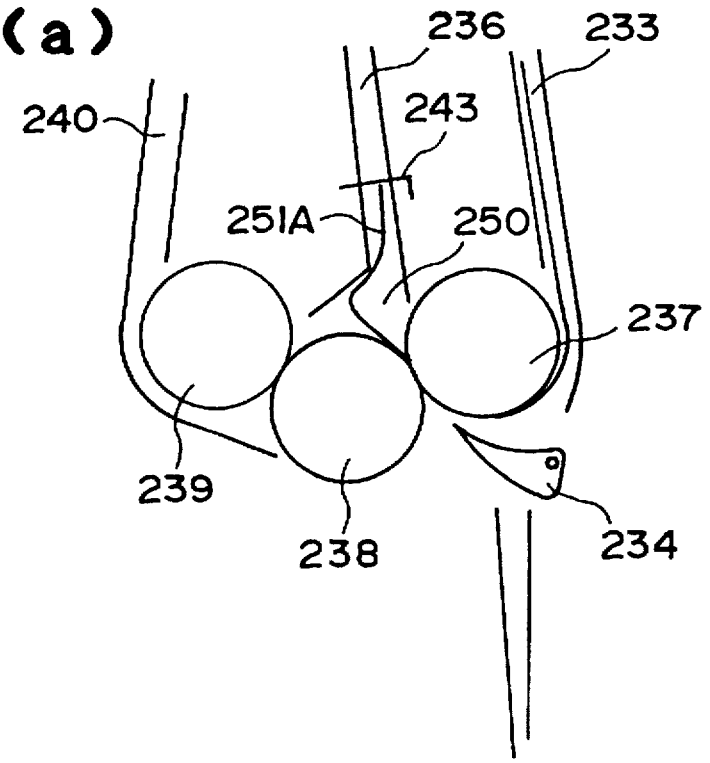
FIGS. 37(*a*) and 37(*b*) are schematic side views of the folding apparatus of the bin module, depicting the apparatus operation in the c-folding mode.
Figure 37B:
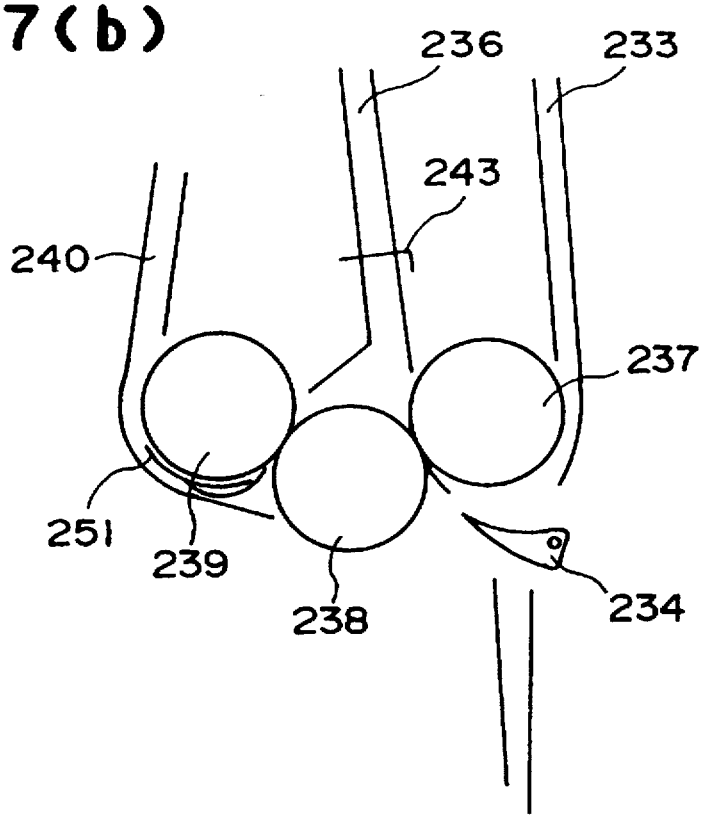

Next, referring to FIG. 37(*a*), as the leading end of the sheet 251 comes in contact with a stopper 243, the sheet 251 is bent in such a manner that the middle section of the downstream portion of the sheet 251 is caused to form a loop 250, and this loop 250 is nipped between a pair of folding rollers 238 and 239. As a result, the downstream portion of the sheet 251 is folded as shown in FIG. 37(*b*), at a folding line 251A. Thereafter, the sheet 251 is passed through a path 240, and then is discharged by a pair of discharge rollers 231 and 232.

Figure 38A:
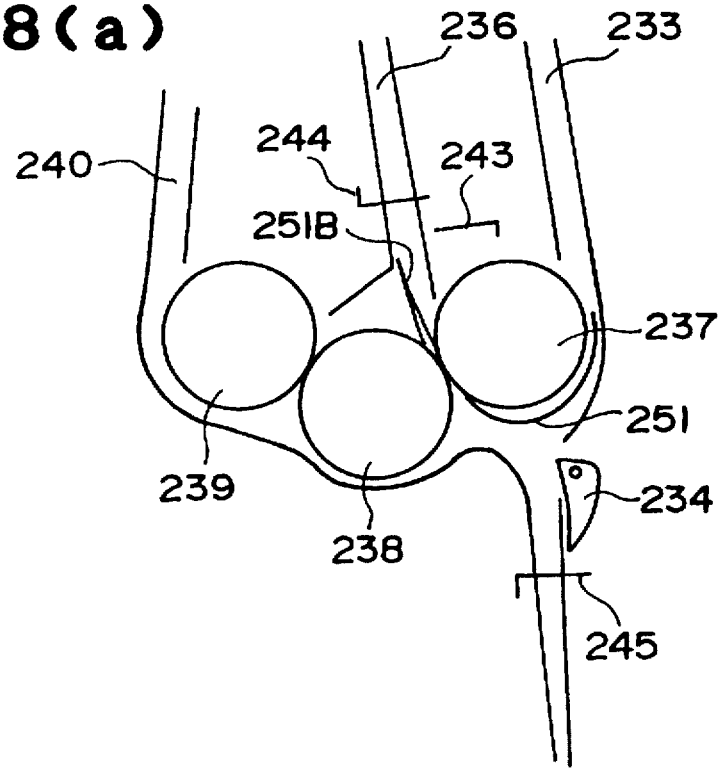
FIGS. 38(*a*) and 38(*b*) are schematic side views of the folding apparatus of the bin module, depicting the apparatus operation in the Z-folding mode.
Figure 38B:
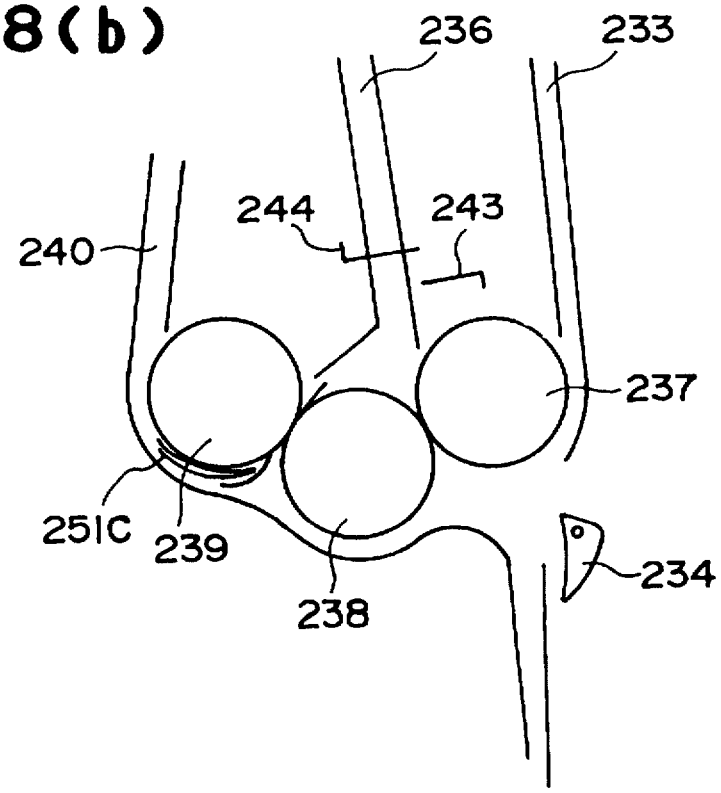
Figure 39:
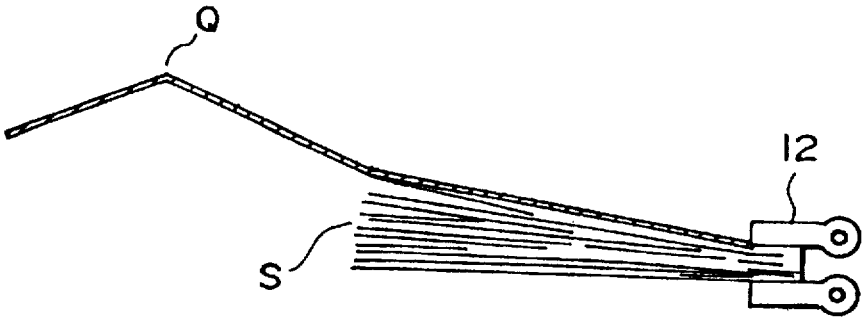
FIG. 39 is a schematic side view of he folding apparatus of the bin module, depicting a state in which a folded sheet has become open during the sheet set transfer.

The third mode, the Z-folding mode, is a mode for folding the sheet 251 in half, and then, folding back one of the folded halves. More specifically, the sheet 251 introduced by the pair of entrance rollers 227 and 228 is delivered to the path 233 by the deflector 229, and is allowed to enter a path 242 by a deflector 234. As the leading end of the sheet 251 comes in contact with a stopper 245, the sheet 251 is bent, forming a loop at a point substantially ¼ the length of the sheet 251 from the leading end, in the same manner as in the C-folding mode. This loop is nipped by the pair of folding rollers 237 and 238. As a result, the sheet 251 is folded once at a folding line 251B (FIG. 38(*a*)).

Next, the sheet 251, which has been folded once, is guided into the folding path 236. As the folded sheet 251 comes in contact with a stopper 244, a loop is formed by the center portion of the folded sheet 251 as described above, and this loop is nipped by the pair of folding rollers 238 and 239, causing the folded sheet 251 to be folded again at a folding line 251 (FIG. 38(*b*)). Thereafter, the Z-folded sheet 251, that is, the sheet 251 folded twice, once forward and once backward, is discharged by the pair of the discharge rollers 231 and 232 through the path 240.

Figure 15:
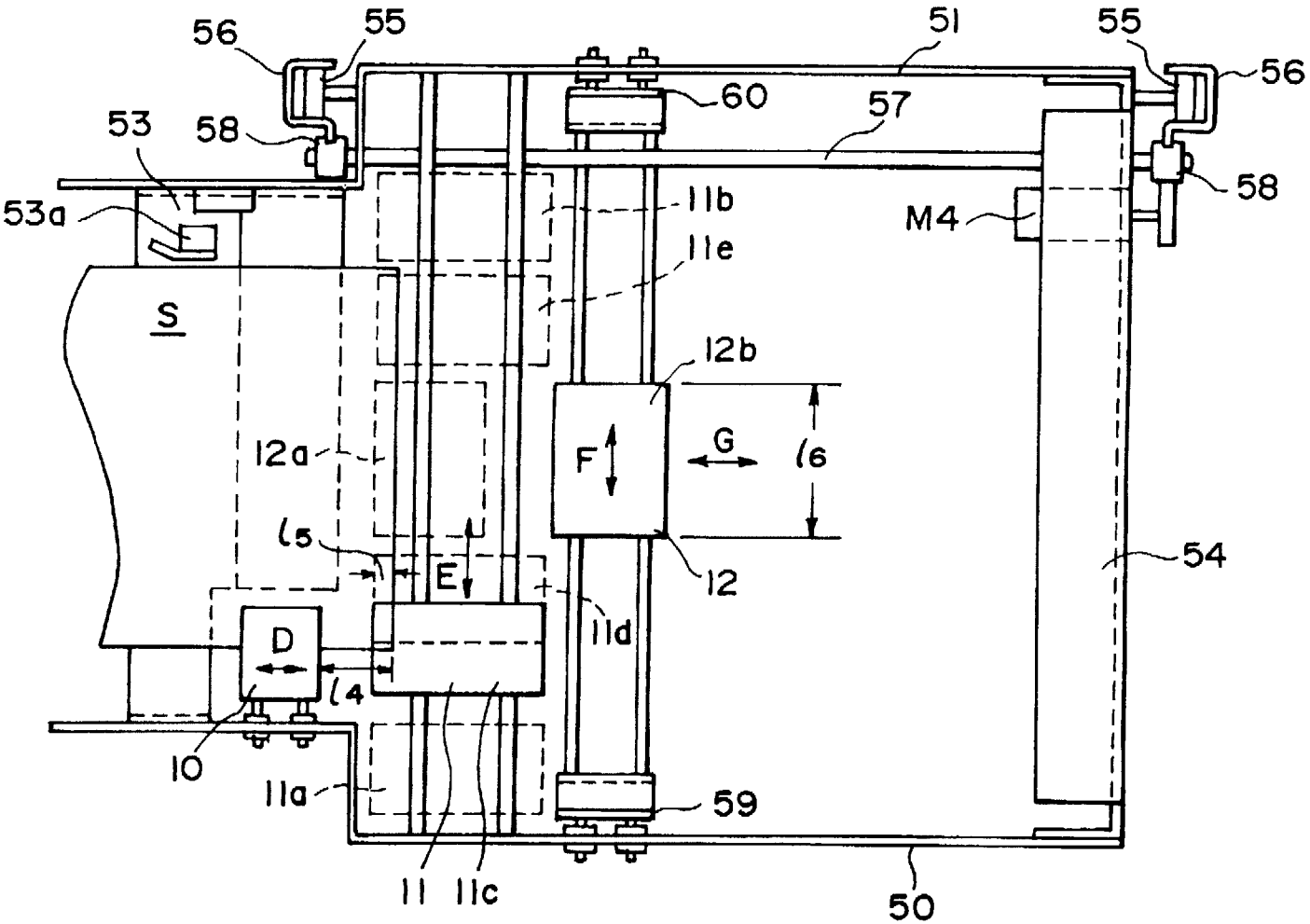
FIG. 15 is a plan view of the gripping-stapling unit of the bin module.
Figure 16:
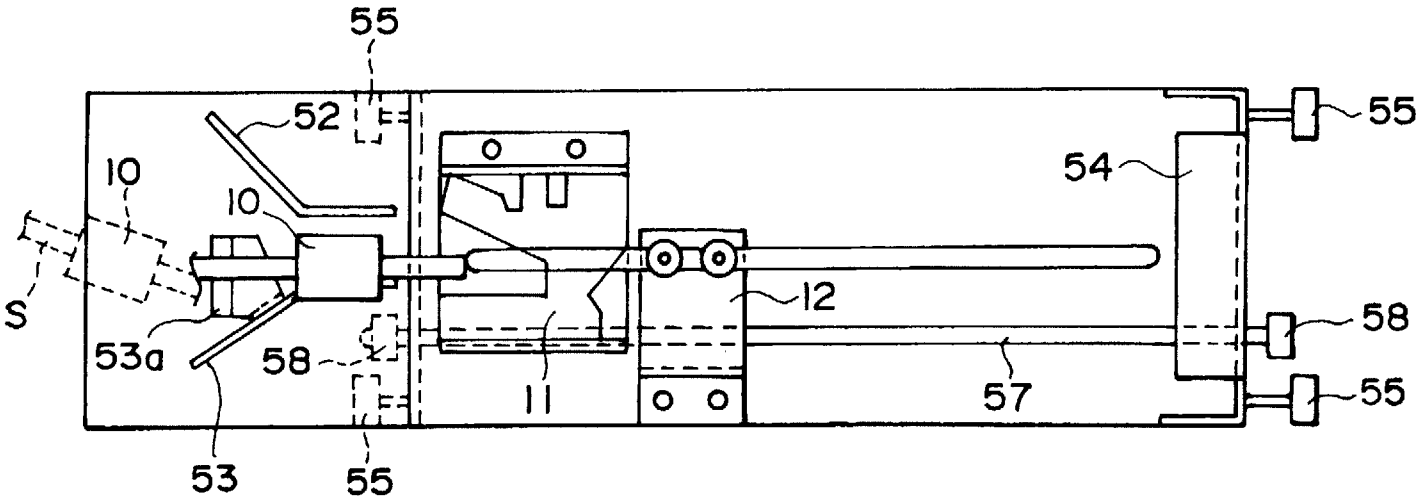
FIG. 16 is a side view of the gripping-stapling unit of the bin module.

Next, referring to FIGS. 15 and 16, the gripping-stapling unit 9 will be described. FIG. 15 is a plan view of the gripping-stapling unit 9, and FIG. 16 is a front view thereof.

The gripping-stapling unit 9 has a frame structure comprising a front plate 50, a rear plate 51, guide stays 52 and 53, and a right stay 54. The guide stays 52, 53 and 54 are disposed to bridge between the front plate 50 and the rear plate 51. At the right rear corner and the left rear corner of this frame structure, two rollers are crimped to the frame structure: a total of four rollers are crimped to the frame structure. At the rear side of the guide stay 53, a guiding member 53*a* for guiding the sheet set during the sheet transfer operation is attached. The four rollers 55 are guided by a pair of rails 56 fixed to the main assembly side. The rack cut across the length of the rail 56 engages with a pinion gear 58 mounted at each end of a shaft 57 which horizontally penetrates the frame structure in parallel to the rear plate 50. Therefore, the entire frame structure can be vertically moved by transmitting the driving force from a motor M4 to the pinion gear.

There are three moving components in the frame structure. A edge pick-up gripper 10 is movable in the direction indicated by an arrow mark D in FIG. 15. It grips the sheet set S by the right front portion adjacent to the front reference, and pulls the sheet set to the right. After the sheet set S is pulled out, a distance 14 from the right end of the edge pick-up gripper 10 to the edge of the sheet set S is rendered longer than a distance is from the left end of the stapler 11 to the edge of the sheet set S.

The stapler 11 is movable in the direction indicated by an arrow mark E in FIG. 15; it can be moved to the retracted position in front, the retracted position in the rear, or any point across the edge of the sheet set.

The transfer gripper 12 is movable in the direction indicated by an arrow mark F in FIG. 15, that is, the width direction of the sheet set and also is movable together with the front and rear plate 59 and 60 in the direction of an arrow mark G, that is, the longitudinal direction of the sheet set S. Therefore, it can grip substantially the middle portion of the sheet set in the width direction, regardless of the sheet size, and can pull the sheet set completely out of the bin in the direction of the arrow mark G (to the right in the drawing), transferring it onto the stacker, which will be described later.

The movement of the transfer gripper 12 in the arrow F direction is used not only for positioning the transfer gripper 12 at a point matching the sheet size, but also for sorting the sheet sets onto the stacker. More specifically, when the sheet set is transferred onto the stacker, the distance the sheet set is pulled in the arrow G direction is dependent on the sheet size, but the sheet set movement in the arrow mark F direction is optional therefore, when different printing jobs using the sheets of the same size are continuously carried out, the sheet sets belonging to each job can be sorted by moving the sheet sets by different distances in the arrow F direction.

The measurement 16 of the transfer gripper 12 in the front to rear direction is set up to be a measurement which allows the gripper 12 to grip the edge of the sheet set S even when the stapler is positioned at a point where it acts on the sheet set Next, each of the moving components 10, 11, and 12 within the grip ping-stapling unit 9 will be described in detail.

First, the gripping portion for gripping the sheet set will be described. It has a structure common to the edge pick-up gripper 10 and the transfer gripper 12 (FIG. 17).

Figure 17:
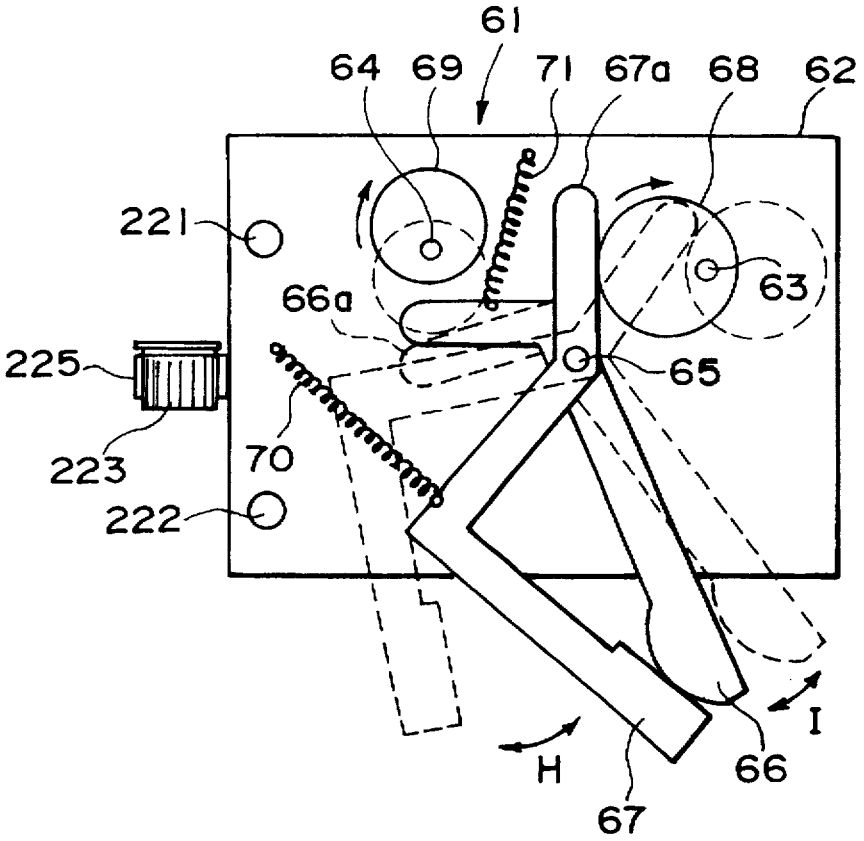
FIG. 17 is a side view of the gripping portion of the bin module.

Referring to FIG. 17, three shafts 63, 64 and 65 are supported by side plates 62 and 62. The shaft 65 holds an upper jaw 66 and a bottom jaw 67. They oscillate in the direction of arrow marks H and I (solid line, and broken line), respectively as a bottom jaw cam 68 fixedly mounted on the shaft 63, and an upper jaw cam 69 fixedly mounted on the shaft 64, rotate in the directions of the correspondent arrow marks. A spring member 70 presses the cam side portion 67*a* of the bottom jaw 67 onto the bottom gripper cam 68, a spring member 71 presses the cam side portion 66*a* of the upper jaw 66 onto the upper gripper cam 69, so that the pressure applied to the upper jaw and the bottom jaw balance. The cam 68 for the bottom jaw and the cam 69 for the upper jaw are driven by an unillustrated motor M5 (for the edge pick-up gripper), an a motor M6 (for the transfer gripper).

As described above, the edge pick-up gripper 10 and he transfer gripper 12 are the same in basic structure, but their gripping pressure, gripping width, maximum distance between the opened jaw, and the like may be optimally set up to match the situation.

For example, in this embodiment, the width of the edge pick-up gripper is rendered smaller in consideration of the available space. But, the gripping pressure of the edge pick-up gripper is set up to be relatively high in order to prevent the sheets in a sheet set from becoming disarranged due to the fact that the edge pick-up gripper grips the sheet set only on the reference side. Further, the opening distance is kept on the smaller side to allow the edge pick-up gripper to enter the bin interval. On the other hand, the gripping pressure of the transfer gripper may be kept on the lower side since it grips the center portion of the sheet set edge. Further, the gripping pressure may be generally set up in consideration of the amount of curling, the basis weight, whether folded or not, the number of sheets in a sheet set, and the like factors.

Figure 18:
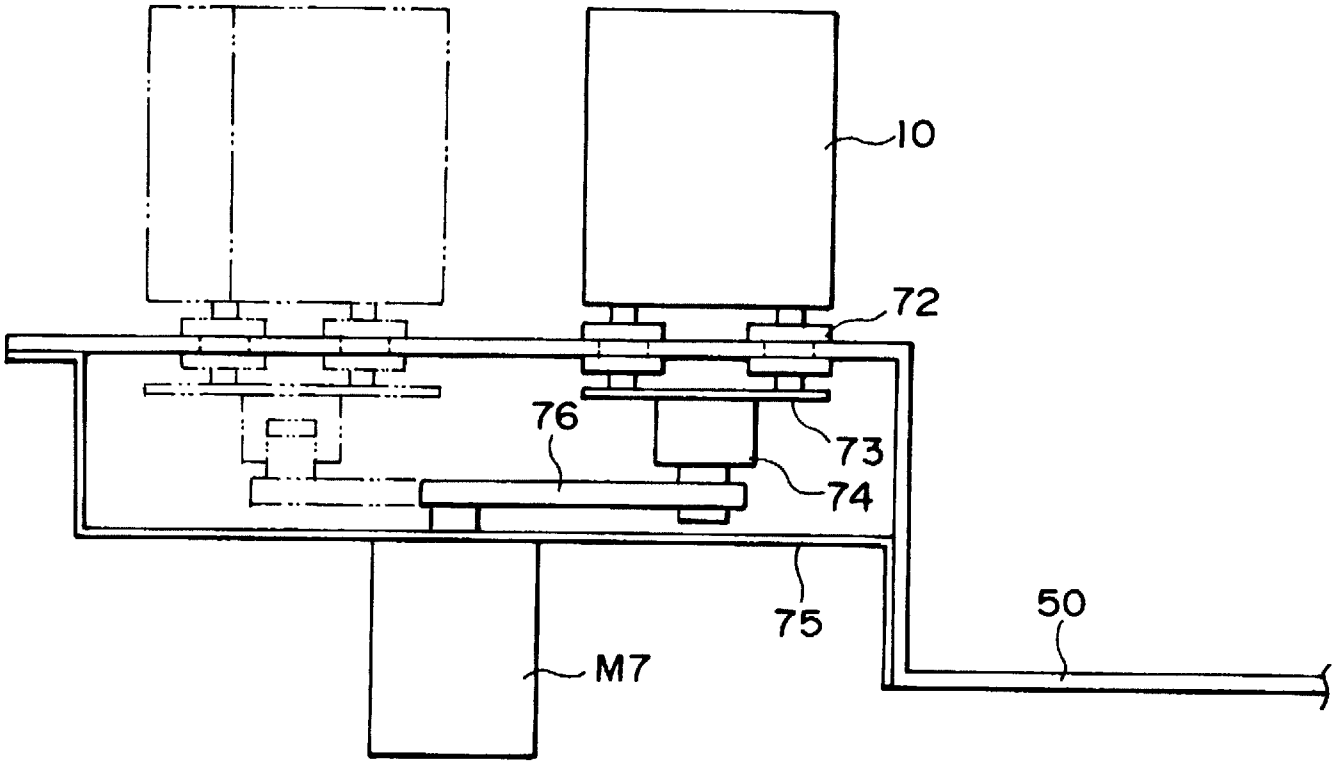
FIG. 18 is a plan view of the edge pick-up gripper driving portion of the bin module.
Figure 19:
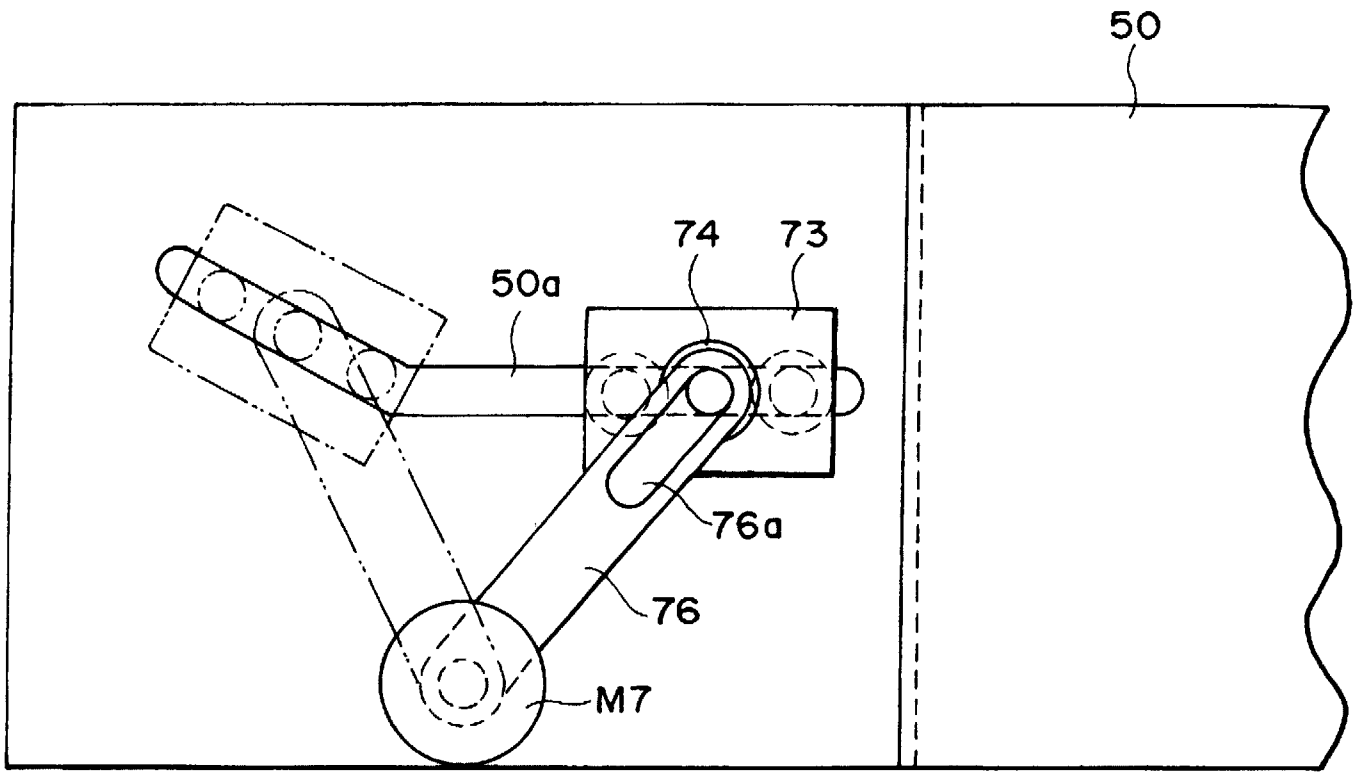
FIG. 19 is a side view of the edge pick-up gripper driving portion of the bin module.

Next, referring to FIGS. 18 and 19, the structure for driving the edge pick-up gripper 10 will be described. FIG. 18 is a plan view, and FIG. 19 is a front view.

Grooved rollers 72 are attached to the front side of the edge pick-up gripper by crimping, and are fitted in an elongated hole 50*a* cut in the front plate 50 of the gripping-stapling unit 9. The elongated hole 50*a* is cut substantially horizontally on the side closer to the stapler 11 (right-hand side in FIG. 19), but at an angle matching the inclination of the bin on the side closer to he bin (left-hand side in FIG. 19). The tips of two shafts supporting the rollers 72 are connected with a metallic plate 73 to which a bin member 74 is attached.

On the other hand, an edge pick-up motor M7 is attached to the front side of the front plate 50, and one end of an oscillating arm 76 is fixedly mounted at the end of the driving shaft of the edge pick-up motor M7. The other end of the oscillating arm 76 is provided with an elongated hole 76*a*, and the end portion of the aforementioned bin member 74 is fitted in this elongated hole 76*a*. As the edge pick-up motor M7 is activated, the oscillating arm 76 oscillates between a position illustrated by a solid line in FIGS. 18 and 19, and a position illustrated by a broken line in FIGS. 18 and 19. With this arrangement, the edge pick-up gripper 10 grips the sheet set at a location along the inclined portion of the elongated hole of the front plate 50; moves the sheet set to a position located along-the horizontal portion of the same elongated hole; releasing the sheet set at the position where the sheet set is moved; and returns to the initial position along the inclined portion.

Figure 20:
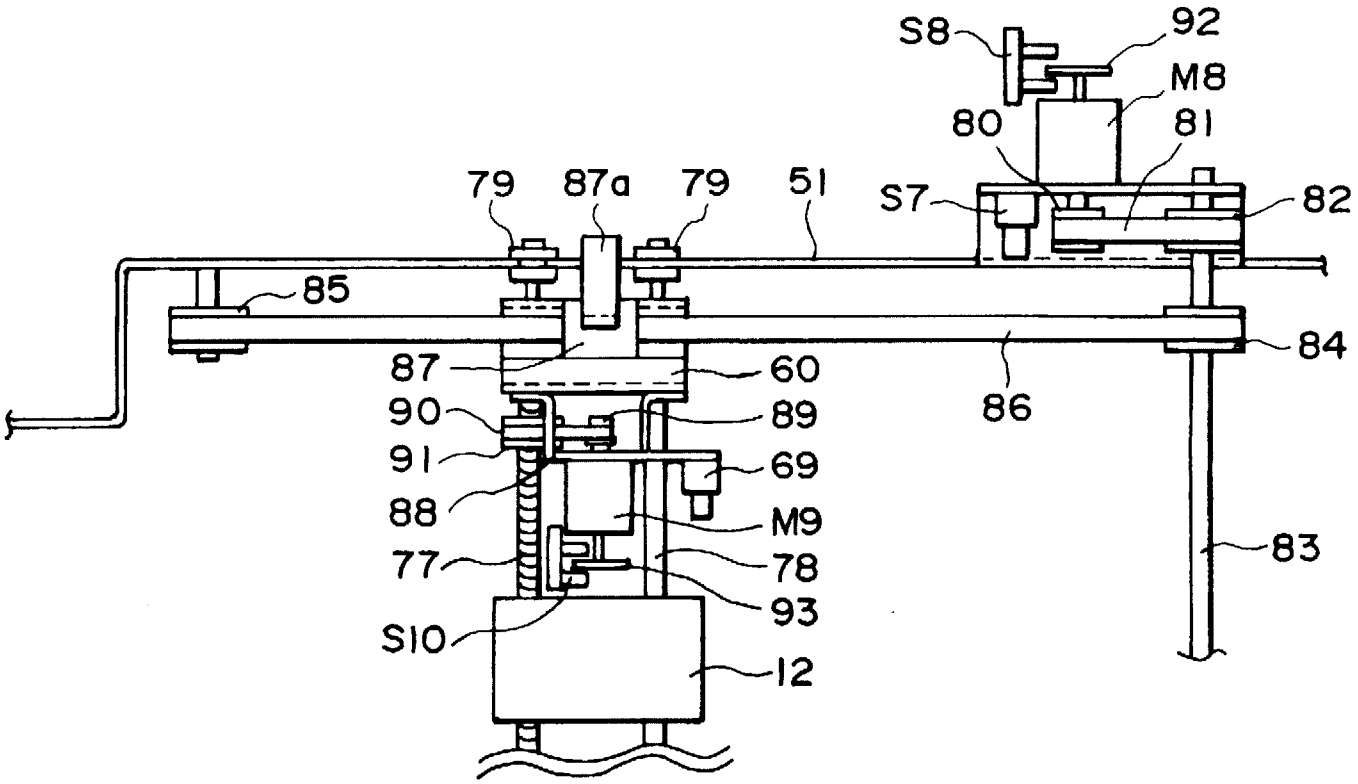
FIG. 20 is a plan view of the transfer gripper driving portion of the bin module.
Figure 21:
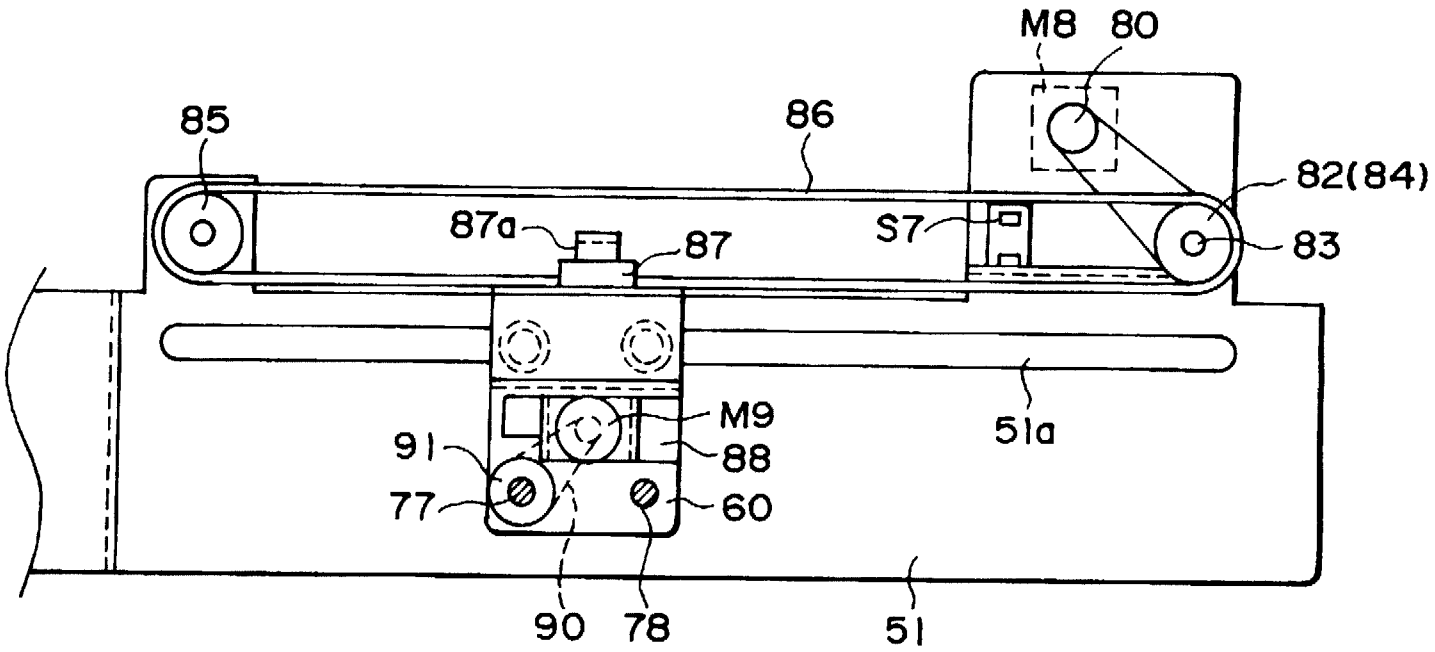
FIG. 21 is a side view of the transfer gripper driving portion of the bin module.

Next, referring to FIGS. 20 and 21, the structure or driving the transfer gripper 12 will be described. FIG. 20 is a plan view, and FIG. 21 is a sectional view as seen from the front side.

First, the movement in the horizontal direction in FIG. 20 or 21, that is, the sheet transferring direction, will be described.

The transfer gripper 12 is supported from underneath by two axes 77 and 78. The axis 77 is a threaded shaft, and the axis 78 is a plain shaft. The axes 77 and 78 are supported between the front plate 50 (unillustrated) and the rear plate 60, wherein the axis 77 is rotatively supported at each end by a bearing, and the axis 78 is solidly fixed at each end. On each side plate, a guide roller 79 is attached by crimping. The roller 79 is allowed to move laterally following the elongated hole 51*a* cut in the unit side plate 51.

A motor M8 for laterally moving the transfer gripper is mounted on the unit side plate 51, and transmits the driving force to a through axis 83 by way of a motor pulley 80, a belt 81 and a pulley 82. On the through axis 83, driving pulleys 84 are mounted, one in front and one in the rear, and belts 86 are stretched between the driving pulleys 84 and correspondent follower pulleys 85. A portion of the belt is fixed to a rear plate 60 using a regulating member 87, whereby the driving force from motor M8 is transmitted to the transfer gripper 12 so as to move laterally the gripper 12 (in the arrow G direction in FIG. 15).

Next, it will be described how to drive the transfer gripper 12 in the direction perpendicular to the sheet set transferring direction, that is, in the vertical direction of FIG. 20.

On the rear plate 60, a motor M9 for moving the transfer gripper 12 in the frontward or rearward direction is attached using a mounting base 88. The driving force from the motor M9 is transmitted to the threaded axis 77 through a motor pulley 89, a belt 90, and a pulley 91. A thread correspondent to the thread of the threaded axis 77 is cut in the transfer gripper 12 on the surface where the gripper 12 makes contact with the threaded axis 77; therefore, the transfer gripper 12 can be moved frontward or rearward by the rotation of the threaded axis 77.

The location of the transfer gripper 12 is determined by detecting its home position and the number of the motor revolution. As for the location in the lateral direction, a projection 87*a* projecting upward from the regulating member 87 is detected by a home position sensor S7, and the distance the transfer gripper moves is detected by a sensor S8 that reads the encoder of the motor M8, whereby the grippe 12 is stopped at a predetermined location.

As for the location in the frontward-rearward direction, a portion of the transfer gripper 12 is detected by the home position sensor S9, and the moving distance is detected by a sensor S10 that reads the encoder 93 of M9, whereby the gripper 12 is stopped at a predetermined location.

Further referring to FIG. 1, the sheet processing apparatus is connected to a controlling apparatus (CPU) for controlling the operations of the aforementioned various components, or functional sections.

Next, the operations of the various structural components or sections will be described, starting with the basic operation of the apparatus.

First, a set of originals is placed on the original table 105 of the automatic original circulating apparatus 202 joined with the main assembly 201 of a copying machine (FIG. 1), and after a predetermined copying mode selection is inputted through an unillustrated control panel, a start key is depressed, whereby various sections of the post-image formation sheet processing apparatus 203 are brought to a state of being on standby in response to the signal generated as the start key is depressed. Hereinafter, the description will be given in correspondence with the mode selections.

(A) Non-sort mode

Figure 29:
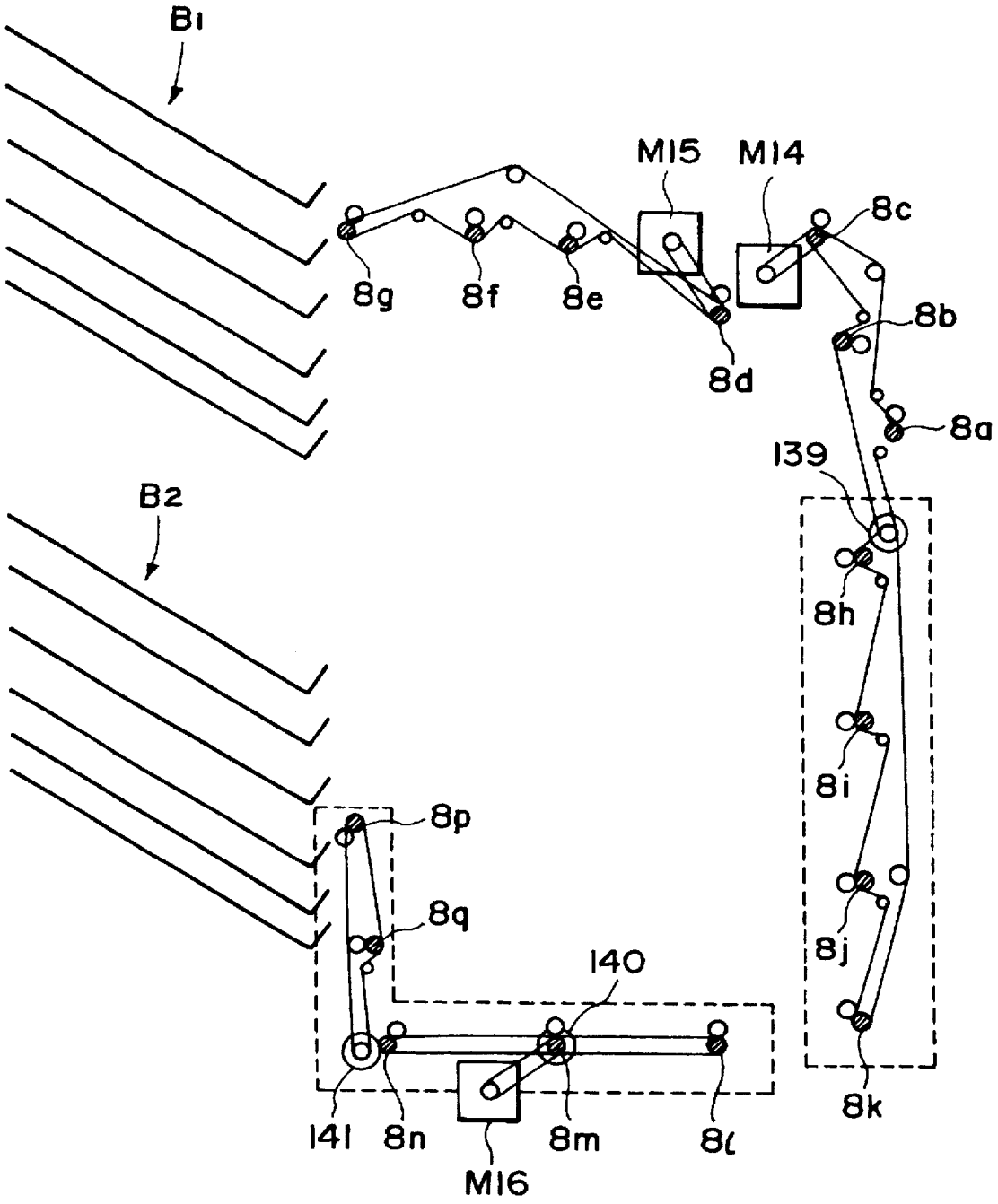
FIG. 29 is a schematic view of the driving system of the transfer system.

Referring to FIG. 2 and FIG. 29, the deflectors 3 and 4 are oriented as outlined by the solid and broken line, respectively, and a motor M14 is controlled so as to rotate the roller pairs 8*a*, 8*b* and 8*c* distributed across the first and sixth sheet delivery paths (FIG. 29). Needless to say, the roller pairs in the folding apparatus 204 are also rotated by an unillustrated folder motor M17, being readied for sheet reception.

It should be noted here that the apparatus readying steps taken up to this point may be carried out after the copying operation begins as long as the sheet processing apparatus can be readied to be on standby before the sheet is discharged from the main assembly of the copying machine. As soon as the sheet processing apparatus enters the standby state, a sheet of original from the original set 206 in FIG. 1 is fed onto the platen glass 207 of the copying machine main assembly 201 by the automatic original circulating apparatus 202, and the copying machine main assembly 201 begins copying.

The first sheet, which is discharged from the copying machine main assembly 201 after an image is formed thereon, passes through the upper path of the folding apparatus 204 and advances into the stapling-stacking apparatus 205 through the sheet entrance 215, where the sheet is directed straight upward by the deflector 3. Then, the sheet is delivered further upward on the right-hand side of the deflector 4, and is discharged into he non-sort ray 5 by a discharge roller pair 8*c*.

(B) Sort mode

In this mode, a special control is sometimes executed depending on the sheet condition or the mode related condition, but at this time, a general operation carried out in the sort mode will be described.

First, during the start-up operation, both deflectors 3 and 4 are oriented as outlined by the solid line, and the roller pairs 8*a*, 8*b*, and 8*d*–8*g* of the upper path of the folding apparatus 204 begin to be rotated. The top and bottom bin modules B1 and B2 are shifted so that the topmost bins B11 and B12 come to the locations where they face the discharge roller pairs 8*g* and 8*p*, respectively. The aligning wall 15 of the bin module is moved to a position correspondent to the sheet width and remains there on standby.

Since the guide member (designated by a reference numeral 42 in FIG. 12, and described later) of the folding apparatus is not involved in this mode, it is checked by the controlling apparatus 270 whether or not the guide member is at the retracted position, so as not to stick out toward the bin. Further, it is also checked by the controlling apparatus whether or not the upright portion of the bin is activated.

The gripping-stapling unit 9 is moved to a position (outlined by the broken line in FIG. 2) correspondent to the sheet set transfer from the top bin module, and is kept there on standby.

Referring to FIG. 15, the moving members within the gripping-stapling unit will be described. The edge pick-up gripper 10 remains on standby at a location indicated in FIG. 15 so that it does not interfere with the sheet on the bin when the bins in the bin module located on the left-hand side of the gripping-stapling unit 9 are vertically moved.

Since the stapler 11 is not operated, it is moved to the retracted position on the front side outlined by the broken line in FIG. 15. The transfer gripper 12 is moved in the arrow mark F direction as well as arrow mark G direction to a position 12*a* outlined by the broken line in FIG. 15, where it can grip the delivered sheet at the substantially middle portion of the sheet edge advanced by the sheet tip positioning gripper 10, and is kept there on standby.

While on standby both the edge pick-up gripper 10 and the transfer gripper 12 are open.

Figure 26:
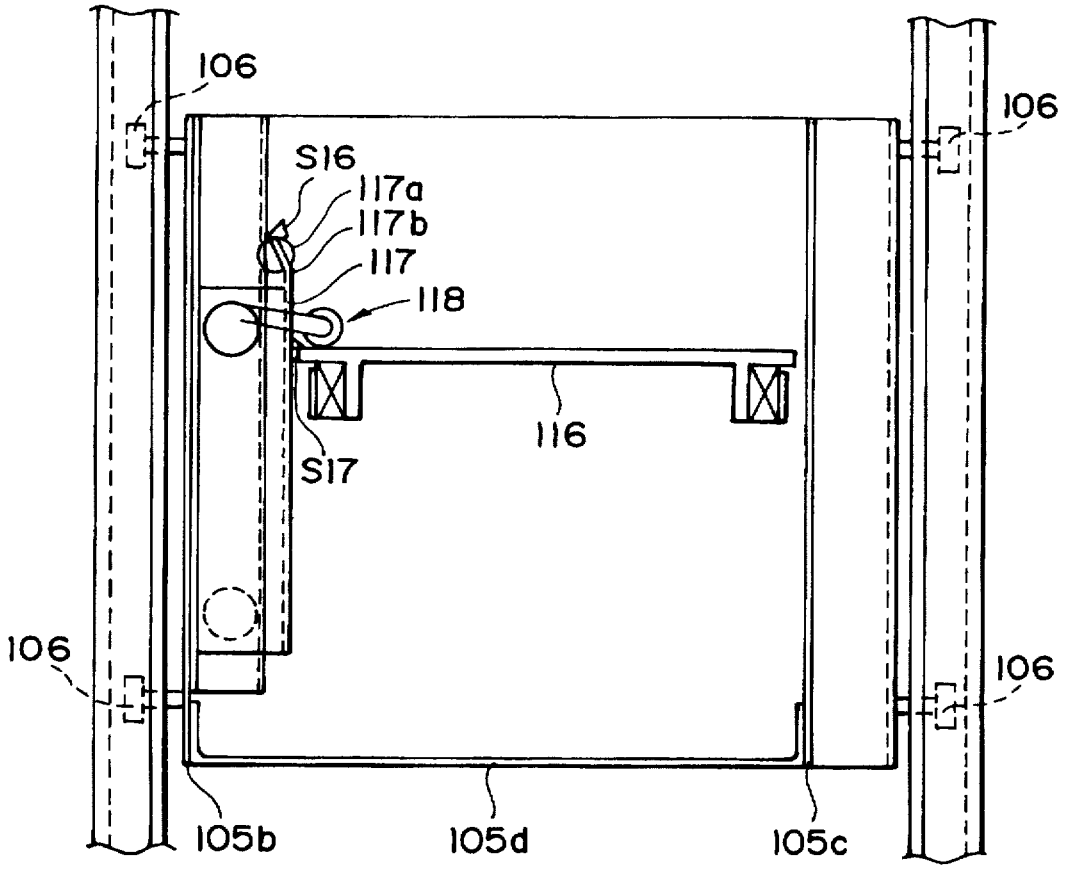
FIG. 26 is a front view of the stacking unit of the bin module.

Next, a stacking unit 13 is moved to a position outlined by the broken line in FIG. 2, being prepared for receiving the sheet set to be delivered from the gripping-stapling unit 9. Referring to FIG. 26, a stacking tray 116, a reference wall 117, or a pressing member 118 within the stacking unit 13 is moved to a position where it allows the top surface of the stacking tray 116 to receive the sheet sets without interference, and the other members are also moved to respective positions to accommodate the stacking tray. The pressing end of the pressing member 118 is sticking out on the stacking tray 116 side as illustrated in FIG. 26.

Thus, the sheet processing apparatus enters the state of being on standby through the start-up operation. Meanwhile, in the main assembly of the copying machine, the original is fed in the same manner as it is in the non-sort mode; an image is formed on a sheet; and the sheet bearing the image is discharged into the sheet processing apparatus.

Referring to FIG. 2, the first sheet is passed through the upper path of the folding apparatus: delivered into the sheet processing apparatus through the sheet entrance 215; directed upward by the deflector 3; directed leftward by the deflector 4; and discharged onto the bin B11 by the discharge roller pair 8*g*.

As soon as a sheet discharge sensor S18 detects the first sheet discharged on he bin B11, the bin module is shifted upward by one bin, so that the bin B12 moves up to the sheet receiving position. This step is repeated until a sheet with the same image is discharged onto all the bins in the top bin module. Then, the first sheet of the original set is replaced with the second sheet of the original, and the copying machine begins to copy the second sheet of the original. At this moment, the top bin module is positioned in such a manner that its bottommost bin (B16 in FIG. 2) is at the sheet receiving position; therefore, when the second sheet of the original is copied, the copy is discharged into the top bin module starting from the bottommost bin and continuing upward. These steps are repeated until all the sheets of the original are copied, and then the sheet reception into the top bin module ends. At this moment, when the number of the sheets in the original set is an odd number, the bottommost bin 16 is at the sheet receiving position, and when it is an even number, the topmost bin B11 is at the sheet receiving position.

Next, the operation moves to a step in which the sheet set is transferred from the bin. In this embodiment, the sheet set transfer position for the top bin module, that is, where the gripping-stapling unit 9 is on standby, is below the sheet receiving position by a distance equivalent to two bins. Therefore, the order in which the sheet is transferred is changed according to the number of the sheets in a set of the original.

Figure 30:
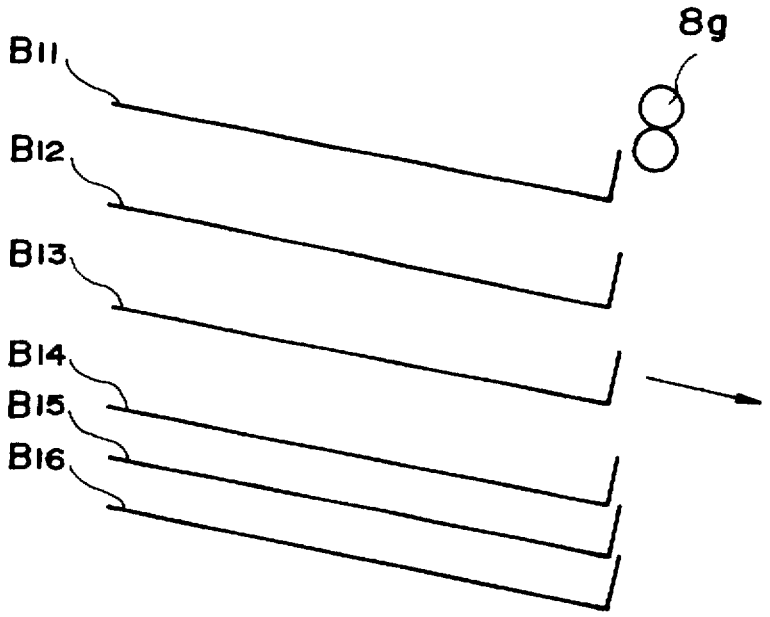
FIG. 30 is a schematic drawing depicting the bin movement as seen from the side.
Figure 31:
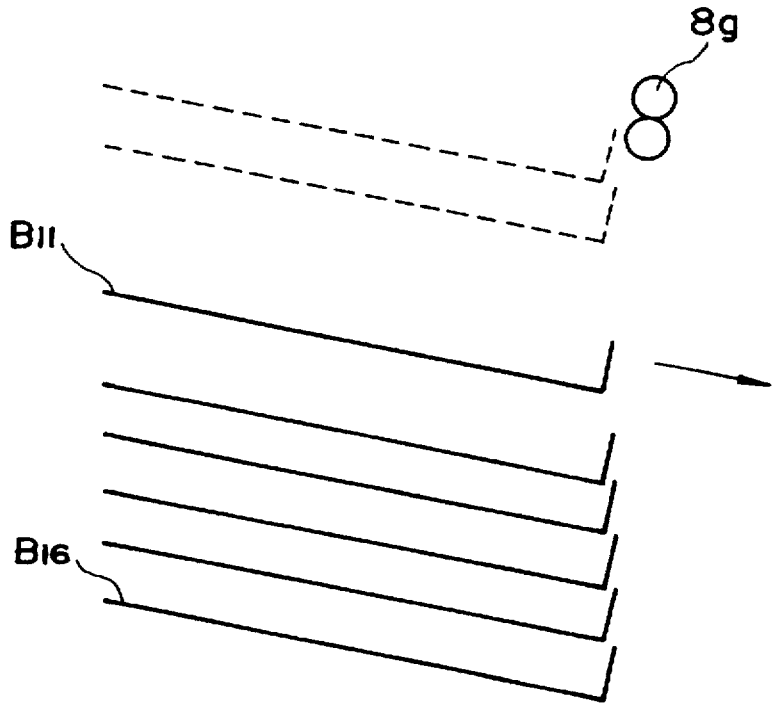
FIG. 31 is a schematic drawing also depicting the bin movement as seen from the side.
Figure 32:
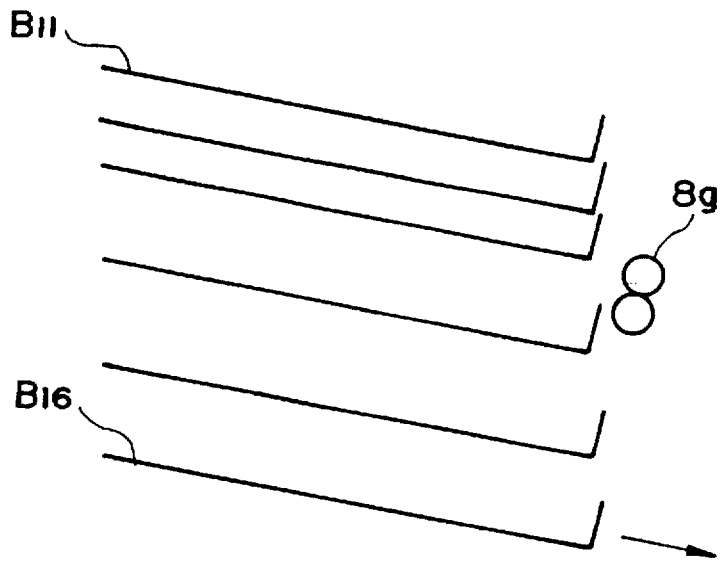
FIG. 32 is a schematic drawing also depicting the bin movement as seen from the side.

(A)-(i) When the number of the sheets in a set of the original is an even number When the sheet count in a set of the original is an even number, the position of the top bin module at the end of the sorting is the same as the one at the beginning of the sorting; in other words, the top bin module is in a state illustrated in FIG. 30. In this case, the sheet set transfer is not started from the B13, which is at the sheet set transfer position at this moment. Instead, the top bin module is lowered by two bins o realize a state illustrated in FIG. 31. Then, the sheet set is first taken out of the topmost bin B11, working sequentially down to the bin B16 (FIG. 32).

Figure 33:
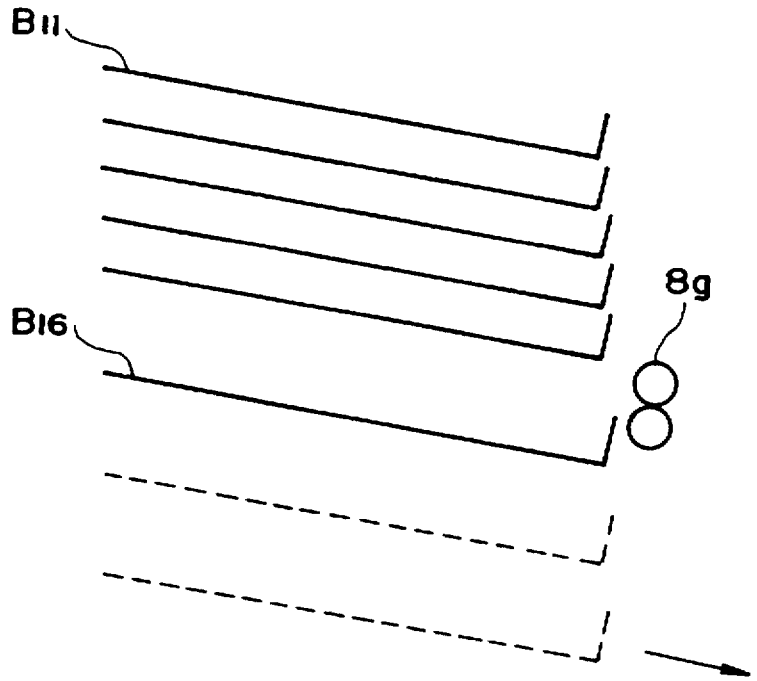
FIG. 33 is a schematic drawing also depicting the bin movement as seen from the side.

Thereafter, the top bin module is raised by two bins to realize a state illustrated in FIG. 33, in which the top bin module is ready for receiving the next group of sheet sets, completing the sheet transfer step.

Assuming that it is necessary to make more sets of copies and the job is continued, when the top bin module begins to receive the second group of sheet sets from the state of FIG. 33, the top bin module again ends up in the state of FIG. 33 since the number of the sheets in the set of the original is an even number. In this case, there is no bin at the sheet set transfer position; therefore, the top bin module is lowered by two bins, realizing the state of FIG. 32, and the sheet set transfer is started from the bottommost bin B16, being sequentially continued up to bin B11. When the bin B11 is finished, the state illustrated in FIG. 31 is realized; therefore, the top bin module is raised by two bins, restoring the state of FIG. 30. In other words, when the top bin module is caused to receive repeatedly the sheet sets, the state of the top bin module is repeatedly changed among the above described states.

(A)-(ii) When the number of the sheets in a set of the original is an odd number.

When the sheet count in the set of the original is an odd number, the position of the top bin module at the end of the sorting is exactly opposite to the one at the beginning. That is, when the sorting begins from the state of FIG. 30, the state of FIG. 33 is realized at the end. At this moment, there is no bin at the sheet set transfer position therefore, the top bin module is lowered by two bins, realizing the sate of FIG. 32, and then, the sheet set transfer is started from the bottommost bin B16, being sequentially continued up to the bin B11. When he bin B11 is finished, the top bin module is in the state of FIG. 31. Therefore, the top bin module is raised by two bins to realize the state of FIG. 30, in which the top bin module is ready for receiving the next group of sheet sets, completing the sheet set transfer step.

When the same job is continued and the next group of sheet sets are received, the sorting starts from the state illustrated in FIG. 30 and ends in the state of FIG. 33. Therefore, the state of the top bin module is also changed among the states described above.

In the case of the bottom bin module in this embodiment, the positional relationship between the sheet receiving positions and sheet set transferring position is opposite to the one in the top bin module; in other word, the sheet transferring position is two bins above the sheet receiving position. At this time, the detailed description as to the bin control for the bottom bin module will not be given, but, the control is substantially the same as the above described control for the top bin module, and similar state changes are repeated. Next, the rest of the description of the sort mode operation will be continued.

Figure 3:
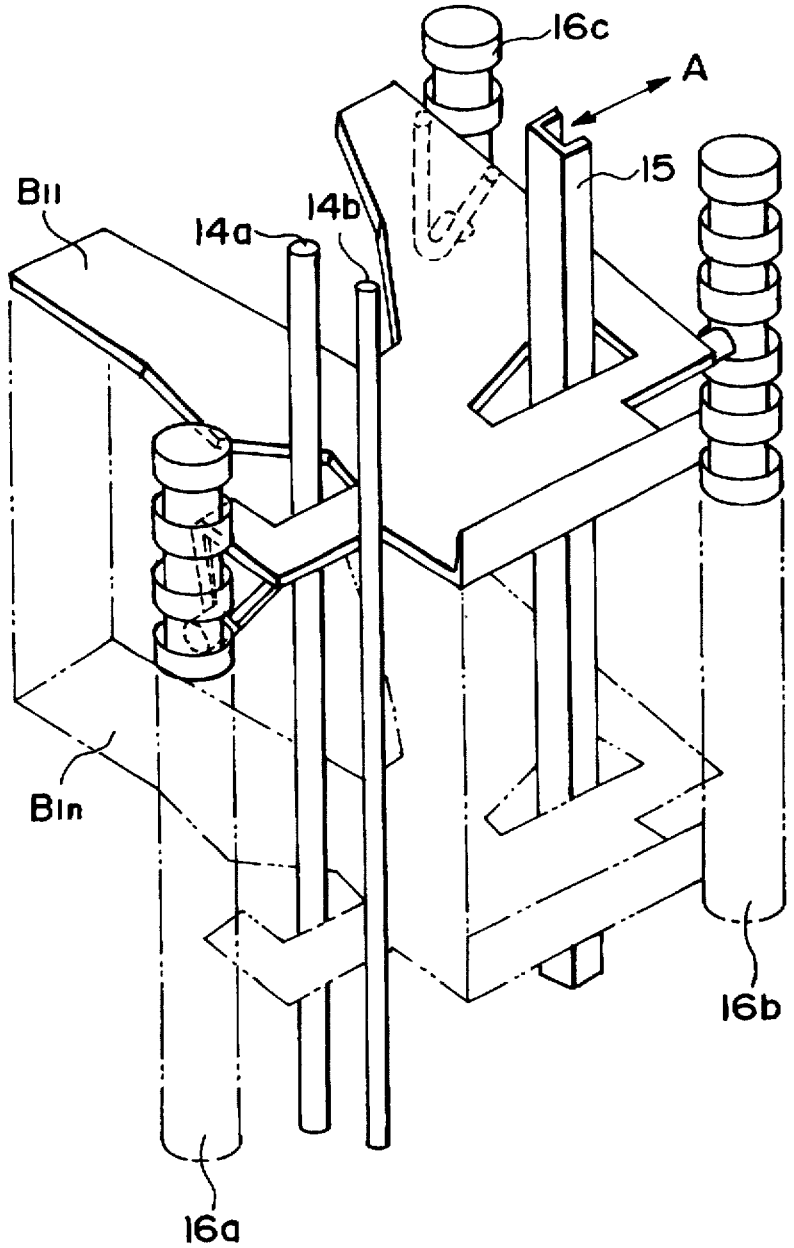
FIG. 3 is a perspective view of a bin module.

Referring to FIG. 3, the sheet deposited on The bin is abutted against the reference rods **14*a* and 14*b*, being thereby aligned, by moving he aligning wall 15** in the direction perpendicular to the sheet delivery direction.

Referring to FIG. 16, after the sheets are sorted and aligned, the sheet set edge pick-up gripper 10 is moved, with the gripping portion open, from the solid line position to the broken line position, where it is caused to grip the sheet set S on the bin. Next, referring to FIG. 14, the upright portion Bj of the bin is released by the solenoid SL1 to allow the sheet set to be transferred.

Figure 4:
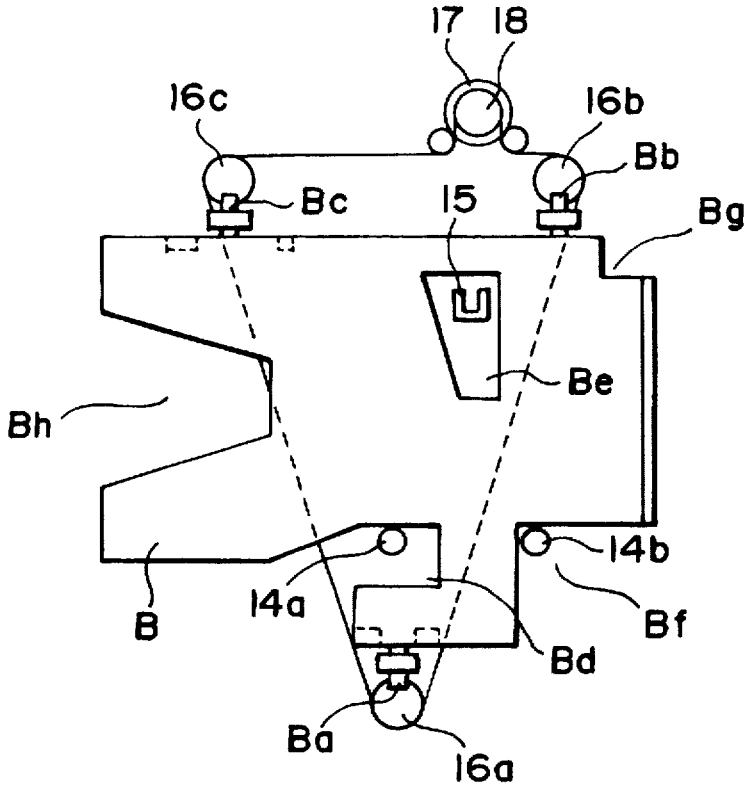
FIG. 4 is a plan view of the bin module.

Next, the sheet set is advanced rightward to a position outlined by a solid line in FIG. 16 while being regulated by the reference rods **14*a* and 14*b* and the aligning wall 15, on the front and rear sides, respectively as shown in FIG. 4, and also, by a guide member 53*b* on the rear side as shown in FIG. 15. At this time, the bottom surface is guided by the bin surface, he surface of the laid down upright portion Bj of the bin, and a guide stay 53, and the top surface is guided by a guide stay 52. Then, the sheet set is temporarily stopped at the solid line position, where it is relayed from the edge pick-up gripper 10 to the transfer gripper 12**, in the following manner.

Figure 34:
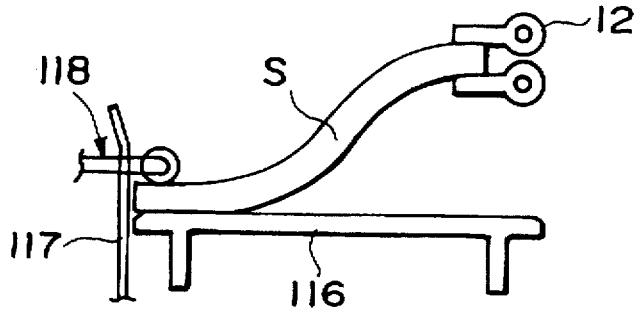
FIG. 34 is a schematic drawing depicting the effects of the stack holding member of the bin module.

First, the transfer gripper 12, which has been on standby, with its jaw open, at a position outlined by the broken line in FIG. 15, grips the sheet set at the substantially center portion of the positioned sheet set edge. Next, the edge pick-up gripper 10 is caused to loosen its grip, being thereby readied for edge pick-up the next sheet set. Thereafter, the transfer gripper 12 is moved to the right in the arrow mark G direction in FIG. 15, pulling the sheet set to the right, and is stopped at a proper position for the sheet size. At this moment, referring to FIG. 34, the trailing end of the sheet set S has fallen go the top surface of the stacking tray 116, with the left edge being regulated by a reference wall 117 of the stacking unit, and the top surface being held down by the pressing member 28 having been driven by the solenoid. Then, the transfer gripper 12 is released to allow the leading end of the sheet set S to fall to the stacking tray.

At this time, the pressing member 28 functions to prevent the sheets within the falling sheet set from shifting.

Next as for the transfer of the second sheet set, it is the same as the transfer of the first one up to the point where he sheet set gripped by the transfer gripper 12 at the substantially middle portion of the sheet set edge is relayed between the grippers; therefore, only the steps thereafter will be described.

After the sheet set is relayed, the transfer ripper 12 is moved in the arrow mark F direction in FIG. 15, by a predetermine distance. At this time, the reference rods, the aligning wall, and the guide member 53*a* may be retracted so as to prevent the sheet set from being regulated on the rear side, or the transfer ripper 12 may be moved in the arrow mark F direction after the trailing end of the sheet set completely clears these laterally regulating members. This movement makes it possible to separate the second sheet set from the first one after it is transferred onto the stacking tray 116.

Figure 35:
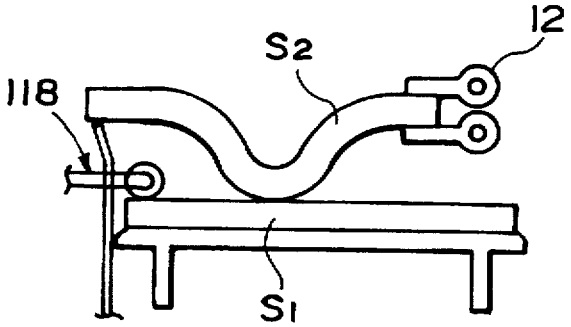
FIG. 35 is a schematic drawing also depicting the effect of the stack holding member of the bin module.

Referring to FIG. 35, while the sheet set is moved to the right by the transfer gripper 12, the central portion of the sheet set S drops on the stacking tray 116 before the trailing end arrives at the predetermined spot. If the sheet set transfer is continued under this condition, the sheet set S2 being transferred is liable to disturb the sheet alignment of the sheet set S1 having been deposited; therefore, the top surface of the sheet set S1 having been deposited held down by the pressing member 28 so that the sheets in the sheet set S1 are prevented from shifting.

The topmost surface of the stack of the sheet sets deposited on the stacking tray 116 is constantly monitored by the sensor, and in response to the signal from th sensor, the stacking tray 116 is gradually lowered so that the interval between the gripping-stapling unit above and the topmost surface of the stacked sheet sets remains constant.

The sheet sets on the stacking tray can be taken out at any time except for the time when the stacking unit is operating. As an operator presses an unillustrated sheet set removal button, the stacking unit moves to a sheet set removal position, and only the stack removal cover becomes openable.

After the sheet sets are taken out and the cover is closed, the sheet processing operation can be continued.

(C) Sorting-stapling Mode

As far as the sheet or sheet set movement is concerned, this mode is the same as the sorting mode; therefore, its description will be omitted here, and only the stapler movement control will be described.

Figure 22:
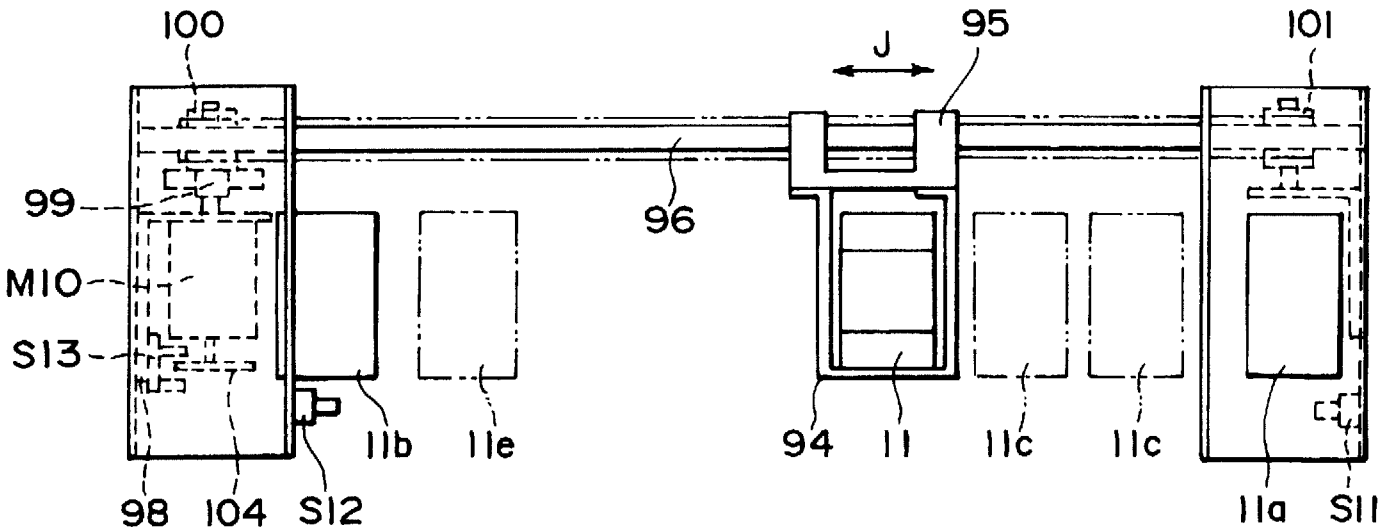
FIG. 22 is a left side view of the stapling unit illustrated in FIG. 15.

Referring to FIGS. 15 and 22, the stapler 11 can be stopped at any location between the front side retracted position 11*a* and the rear side retracted position 11*b*.

(C)-(i) Single Point Binding on Front Side

In the non-stapling modes described above, the stapler 11 is at the front side retracted position 11*a*, but when the single point front side binding mode is selected, the stapler 11 remains on standby at a position 11*c* indicated in FIGS. 15 and 22. Even when the stapler is on standby at a position 11*c* indicated in FIG. 15, the stapler 11 and the transfer gripper 12 can remain on standby without interfering with each other, since the transfer gripper 12 is at a position 12*a*. After stapling the sheet set positioned by the edge pick-up gripper 10, the stapler 11 is moved to the front side retracted position 11*a*, and then, the sheet set is conveyed to the right by the transfer gripper 12. After the trailing end of the sheet bet clears the moving range of the stapler 11, the stapler 11 moves back to the single point front binding position 11*c* and waits for the next sheet set.

(C)-(ii) Two Points Binding

In the two points binding mode, the binding points vary depending on the sheet measurement in the direction perpendicular to the sheet delivery direction. Let it be that the sheet size is such that it is to be bound at two stapling points 11*d* and 11*e* indicated in FIGS. 15 and 22. Also in this case, the stapler 11 does not interfere with the transfer gripper, at whichever of the positions 11*d* and 11*e* indicated in FIG. 15 the stapler 11 may be. As the two points binding mode is selected, the stapler 11 is moved from the front side retracted position 11*a* to the front side binding point 11*d* and is kept there on standby. In his case, the transfer gripper 12 is kept on standby at a position 12*b* outlined by a solid line.

After being advanced by the edge pick-up gripper, the sheet set is stapled on the front side binding point by the stapler 11 at the front side stapling position 11*d*. At this time, the advanced sheet edge is still held by the edge pick-up gripper. Then, the stapler 11 is moved to the position 11*e*, and the sheet set is stapled at the second binding point, that is, the point on the rear side. Next, as soon as the stapler 11 is moved from the position 11*d* to the position 11*e*, the transfer gripper 12 is advanced from the standby position 12*b* to the position 12*a* and grips the sheet set. At this moment, on the other hand, the edge pick-up gripper 10 releases the sheet set. After stapling the sheet set on the second binding point at the stapling position 11*e*, the stapler 11 is moved to the rear side retracted position 11*b*.

Then, as soon as the trailing end of the first sheet set clears the moving range of the stapler 11, the stapler 11 is moved from the retracted position 11*b* to the stapling position 11*e* on the rear side, and receives the second sheet set. However, this time, the stapler 11 first staples the sheet set on the rear binding point and moves to the position 11*d* on the front side. Meanwhile, the transfer gripper 12 is kept on standby at the position 12*b*, as it is for the first sheet set, until the stapler 11 is moved to the second stapling point after finishing the first stapling point. Then, it is moved to the position 12*a*, and after the stapler is moved to the front retracted position, it transfers the sheet set. As described above, in the two points binding mode, the position to which the stapler is retracted is alternated between the front and rear sides in order to reduce the sheet processing time.

(C)-(iii) Single Point Rear Binding Mode

In this mode, the sheet set is bound on the rear side relative to the sheet edge center in the direction perpendicular to the sheet delivery direction; therefore, the movement of the stapler is opposite to the one in the mode (C)-(i). In other words, the stapler 11 shuttles between the rear side retracting position and the stapling position.

(D) Folding Mode

Figure 10:
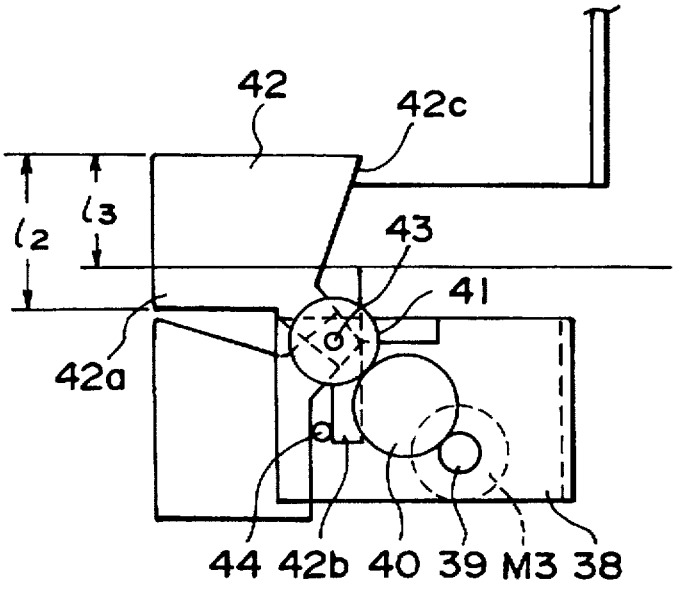
FIG. 10 is a plan view of the sheet folding guiding portion of the bin module.
Figure 11:
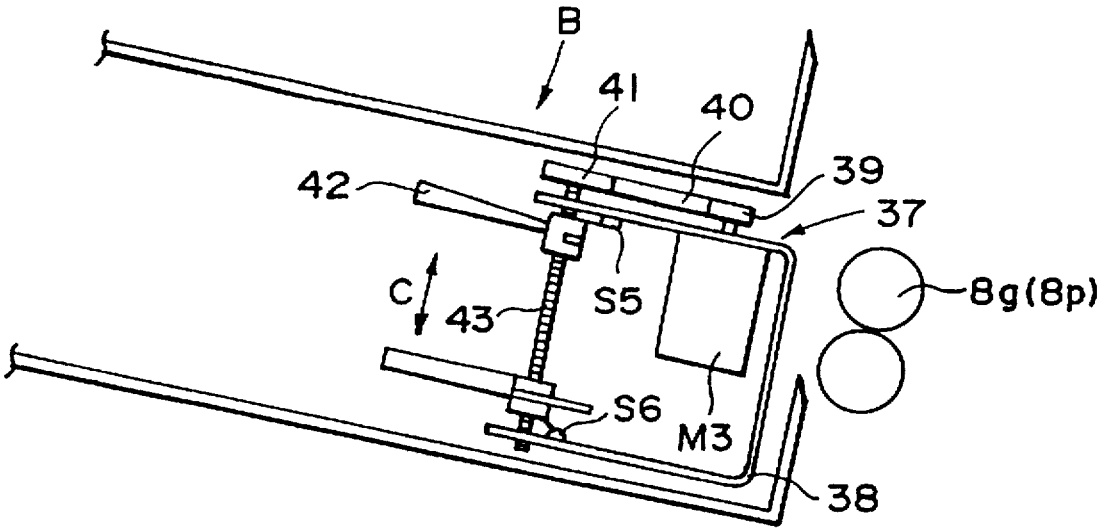
FIG. 11 is a side view of the sheet folding guide portion of the bin module.
Figure 12A:
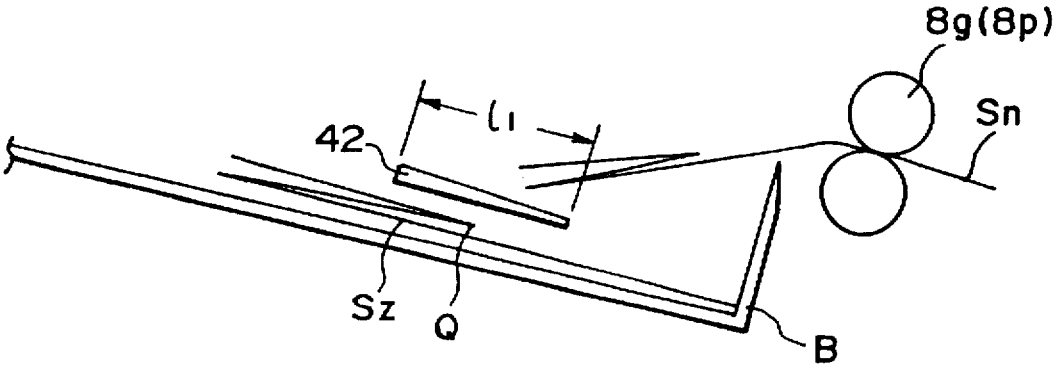
FIG. 12(*a*) and 12(*b*) are schematic views of the sheet folding guide portion; (a) depicting the operation of the sheet folding guide, and (b) depicting the failed accumulation of the folded sheets.
Figure 12B:
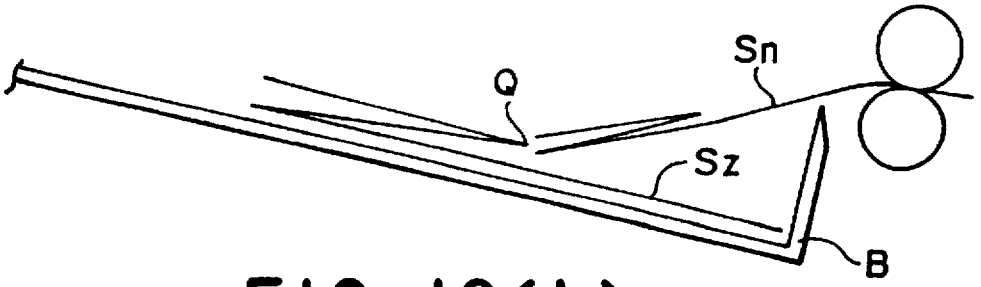

In the folding mode, a relatively long sheet in the sheet delivery direction is subjected to a folding operation in the folding apparatus 204 illustrated in FIG. 2. Thereafter, it is processed in the same manner as a regular size sheet. In other words it is discharged into the bin; processed according to a selected mode; and deposited in the stacking unit 13. However, there is more than one way to fold a sheet: the so-called Z fold, which has a folded edge at the central portion of the sheet in the sheet delivery direction or on the slightly downstream side of the central portion; the C fold for folding a sheet of an overseas size LGL into the LTR size; or the like fold. In the case of these folds, it is liable that the leading edge of a folded sheet being discharged collides with, and/or slides in below, the folded edge of another sheet having been deposited on the bin, and as a result, the alignment of the sheets having been deposited is disturbed, and/or the folded sheet being discharged is not deposited in a proper manner. Therefore, a guide member 42 illustrated in FIG. 10, 11, or 12 is disposed on the bin, on the downstream side of th discharge roller, wherein this guide member 42 is projected over the folded sheet on the bin so that the folded sheet can be properly deposited and aligned.

As for the operation of the guide member 42, when the first folded sheet is discharged into each bin, he guide member is not activated. After the folded sheet is deposited in the bottommost bin for the first time, and before the leading edge of the second folded sheet enters the bin, the guide member 42 is rotated in a manner to project into the space between the bins as illustrated by the top position outlined by the solid line, and hen, is lowered to the position outlined by the broken line in FIG. 12, guiding thereby the next in-coming folded sheet Sn in such a manner as to prevent its leading edge from colliding with the folded edge of the folded sheet having been deposited. Then, after the second sheet is deposited, it is rotated out of the space above the bin and the sheet on the bin. Next, as the bin module is lowered by one bin, whereby the bin immediately above the bottommost bin is disposed at the sheet receiving position, the guide member 42 is rotated into the bin interval, being thereby projected over the folded sheet, and then, is lowered to accommodate the next folded sheet.

The above described steps are repeated to deposit the folded sheets in each bin. However, this operation needs to be carried out only when the topmost sheet accumulated on the bin is a folded sheet, and therefore, the leading edge of the next incoming sheet is liable to slip in below the folded edge of the topmost sheet. For example, in case a set of the original consists of a mixture of large size sheets and small size sheets, and only the large size sheets are to be folded, the guide member 42 does not need to be activated when a sheet is discharged immediately after a small size sheet is deposited on the bin.

Next, the control of the speed, including the acceleration, of the transfer gripper 12 (sheet transferring means) will be described.

Figure 40A:
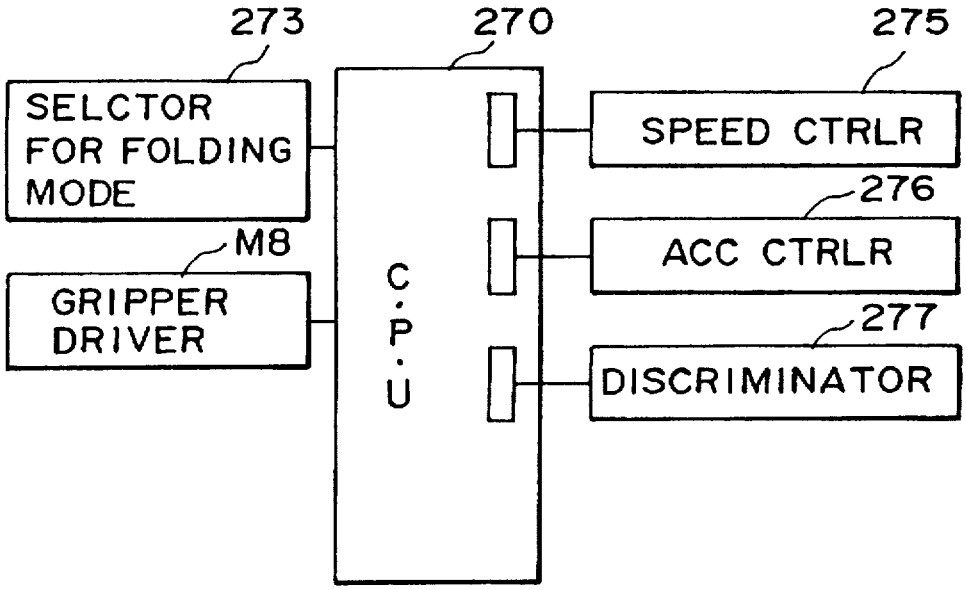
FIG. 40(*a*) is a block diagram of the controlling means in accordance with the present invention, and FIG. 40(*b*) is a graph showing the relationship between the gripper speed and the moving distance (time).
Figure 40B:
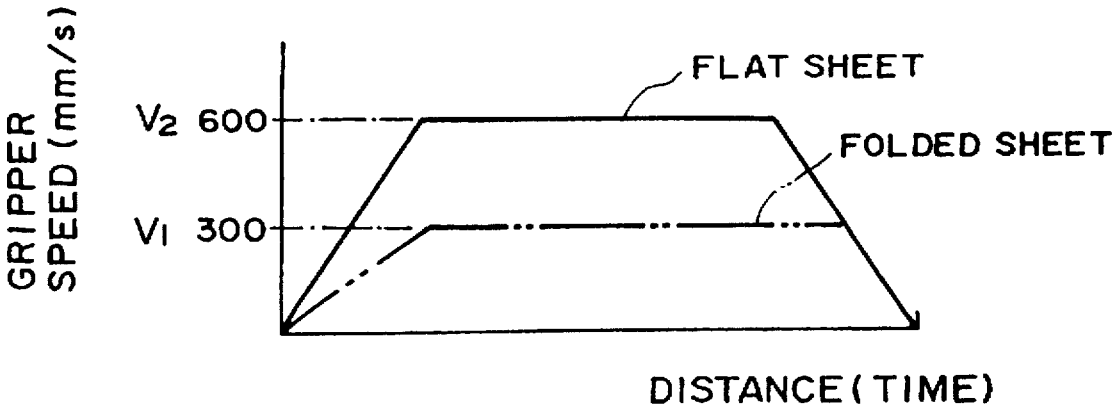
Figure 41:
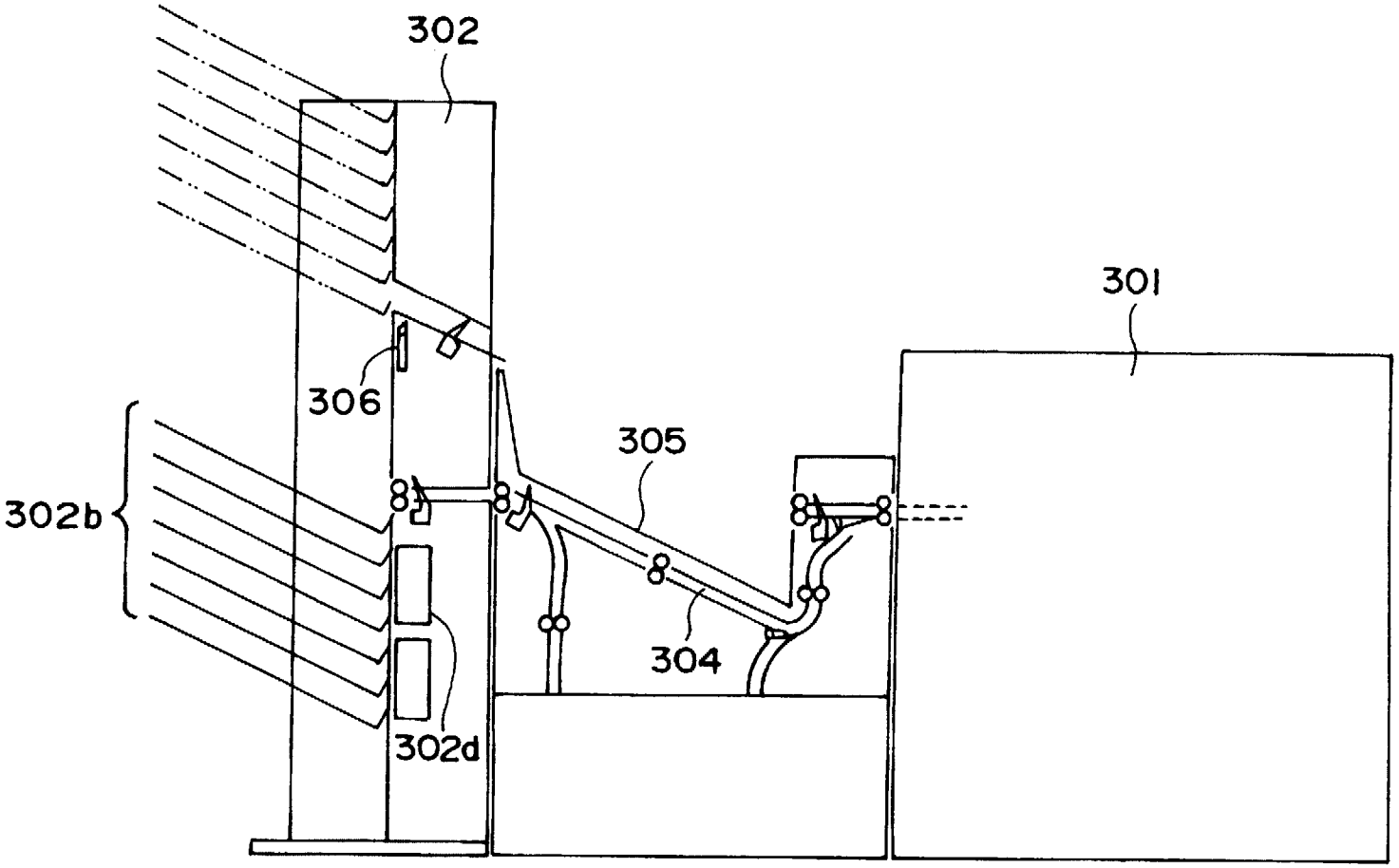
FIG. 41 is a longitudinal section of a typical conventional sheet processing apparatus.
Figure 42:
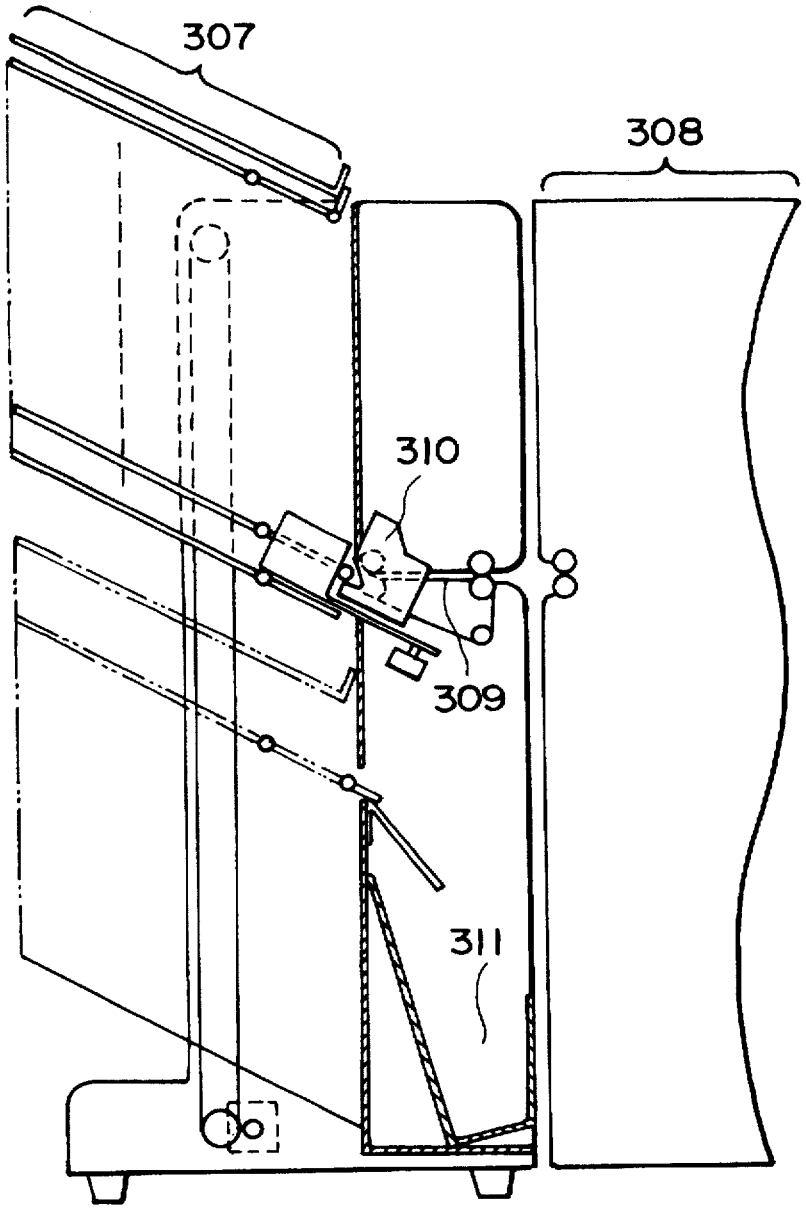
FIG. 42 is a longitudinal section of another example of the conventional sheet processing apparatus.

The transfer speed of the transfer gripper 12 is controlled by the gripper speed controlling means 275 of a controlling apparatus (CPU) 270. For example, when a folding mode involving a set of the original containing a minimum of one sheet which must be folded is selected by a folding mode selecting means 273 (FIG. 40), the speed at which the sheet set deposited on each bin is transferred onto the stack tray 116 by the transfer gripper 12 is controlled so that it becomes slower than the normal speed, that is, the speed for a mode involving no folding. The distance the sheet set is transferred is 600 mm to 700 mm, and the control is executed by controlling the current supplied to the motor M8. More specifically, the normal speed is approximately 600 mm/sec, and when involving the folded sheet, the speed is reduced to approximately ½ (300 mm/sec) (FIG. 40(*b*)). The speed reduction does not need to be approximately ½; the speed may be reduced by 20% to 30%.

This is because when a sheet set containing the folded sheets is transferred at the same speed as a sheet set containing no folded sheet, air resistance, shock, or the like increases during the transfer, affecting the behavior of the sheet set; for example, the folded portion of the folded sheet is raised, detrimentally affecting the manner in which the sheet sets are accumulated on the stacking tray 116.

As described above, according to the present invention, when the sheet set containing the folded sheets is transferred, the sheet set transfer speed is reduced to an optimum speed at which the sheet set behavior remains stable; therefore, the sheet set containing the folded sheets can be accumulated in the same preferable manner as the sheet set containing no folded sheets.

Further, according to the present invention, the acceleration and deceleration of the transfer gripper 12 is also controlled by the gripper acceleration controlling means 276 of the controlling apparatus 270; when the sheet set containing the folded sheets is transferred, the acceleration and the deceleration of the transfer gripper is reduced so that the behavior of the sheet se remains stable. Therefore, the sheet set containing the folded sheets can be accumulated in the same preferable manner as the sheet set containing no folded sheets.

However, when the above sheet set transfer control is executed for all the sheet sets containing the folded sheets, the time needed for the sheet set transfer increases, which in turn increases the overall processing time of th system. In order to prevent such increase in the processing time, the following measure is taken so that the processing time does not increase even when in the folding mode.

The aforementioned controlling apparatus 270 comprises a sheet condition detecting means 277 for detecting whether or not the last sheet (the uppermost sheet of a sheet set) delivered to a bin group B is a folded sheet, wherein when the sheet condition detecting means 277 determines that the last sheet of a sheet set is a sheet with no folded edge, the controlling apparatus 270 executes a control so that the sheet set is transferred at the same speed as a sheet set containing no folded sheet. The sheet condition detecting means 277 determines the sheet condition of the last sheet on the basis of whether the last sheet has been delivered through the sheet folding portion or the through path.

This is because the force working to raise the folded portion of the sheet below the uppermost sheet, is regulated by the rigidity of the uppermost sheet which has not been folded, and therefore, the behavior of the sheet set remains stable provided that the shock applied to the sheet set is moderate. As a result even a sheet set containing the folded sheets can be transferred at the normal speed, being accumulated as preferably as a sheet set with no folded sheet, as long as the uppermost sheet of the sheet set is not a folded sheet. Thus, the processing time is prevented from increasing. In this case, the sheet set may be transferred at the speed V2, or a speed between the speeds V2 and V1.

In the preceding descriptions, the general structure of the post-image formation sheet processing apparatus was described. Hereinafter, the components of the apparatus will be described in more detail, for informational purposes only.

First, the bin modules B1 and B2 will be described.

FIG. 3 is a perspective view of the bin module. Below, the description will be given with reference to the module B1, and the same structure applies to the bin module B2.

The bin module B1 essentially comprises bins B11 - B1n, two reference rods 14*a* and 14*b*, an aligning wall 15, lead cam 16*a*–16*c* for moving vertically the bins, and driving sections therefore. The reference rods 14*a* and 14*b* are the members that define the referential line for the sheet discharged onto the bin when the post-image formation sheet processing such as stapling is carried out, and normally, it is disposed at a location retracted slightly from the point where the edge of the discharged sheet settles. The aligning wall 15 comes in contact with the edge of the sheet discharged onto the bin, and shifts the sheets in the direction perpendicular to the sheet delivery direction (direction indicated by an arrow A), one by one, or by two or more, whereby the sheet is aligned as the sheet edge opposite to the aligning wall 15 is abutted on the reference rods 4*a* and 4*b*.

Referring to FIG. 3, and FIG. 4, which is a plan view of the bin module, the lead cams 16*a*, 16*b* and 16*c* are a spiral cam, the peripheral surface of which is provided with a spiral cam surface, wherein the cam 16*a* is disposed at the front, and the lead cams 16*b* and 16*c* are disposed at the rear. Each cam engages with correspondent roller Ba, Bb or Bc projecting from the bin; therefore, one synchronous rotation of the lead cam vertically moves he bins by a predetermined pitch.

Referring to FIG. 4, the bin has a cutaway portion Bd correspondent to the reference rod, a hole Be correspondent to the aligning wall, a cutaway portion Bf correspondent to the gripper, which will be described later, a cutaway portion Bg correspondent to the driving mechanism for erecting the vertical portion of the bin, and a cutaway portion Bh needed operationally.

Figure 5B:
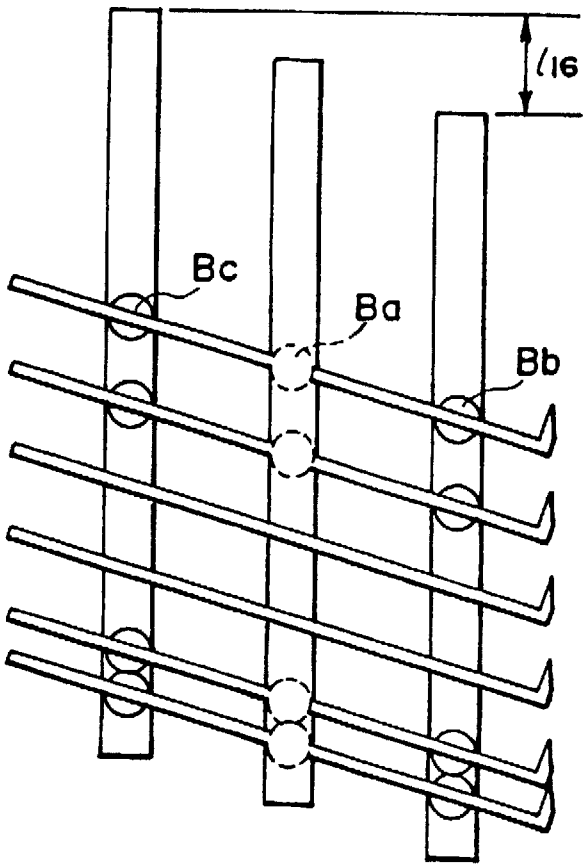
FIGS. 5(*a*) and 5(*b*) are side views of the bin module.
Figure 5A:
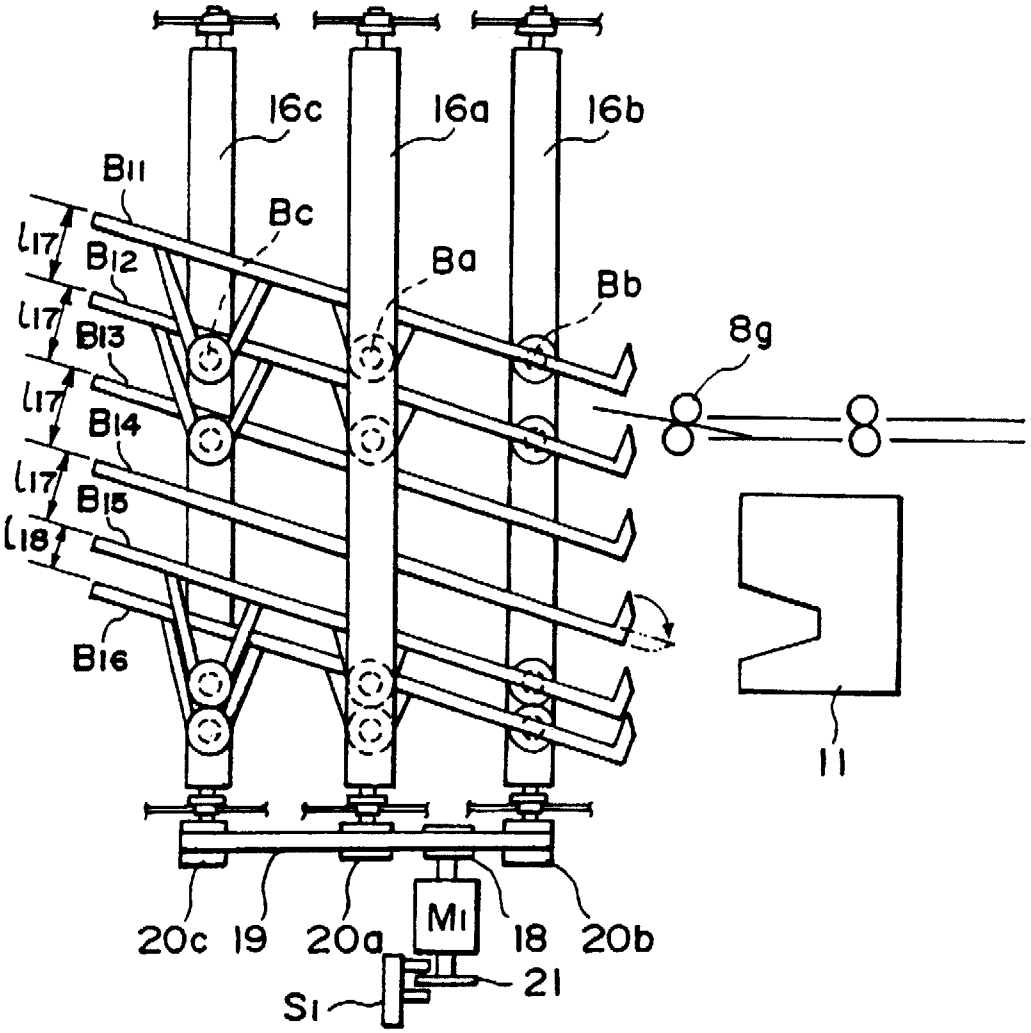

FIGS. 5(*b*) and 5(*b*)are front views of the bin module. In the drawing, the bins are vertically stacked in parallel, being slightly angled relative to the horizontal plane, whereas the bin rollers Ba, Bb and Bc are at the same level. More specifically, the position of the bin roller Bb attached toward the right end portion of the bin is next to the referential surface of the bin, whereas the position of the bin roller Bc attached toward the left end portion of the bin, using a V-shaped fixing arm, is substantially below the referential surface of the bin.

With this arrangement, even when the adjacent bins come extremely close to each other as the bins B15 and B16 do in FIG. 5(*a*), interference between the arms can be avoided. Further, the bin rollers Be, Bb and Bc are all at the same level; therefore, the lead cams 16*a*, 16*b* and 16*c* can all be positioned at the same level, which allows the reduction in the overall size of the apparatus. In other words, in comparison with an arrangement illustrated in FIG. 5(*b*), in which the rollers Be, Bb and Bc are positioned immediately next to the referential surface of the bin, the arrangement in this embodiment can reduce the overall apparatus size by an equivalence of $1_{16}$ in FIG. 15(*b*).

Figure 6:
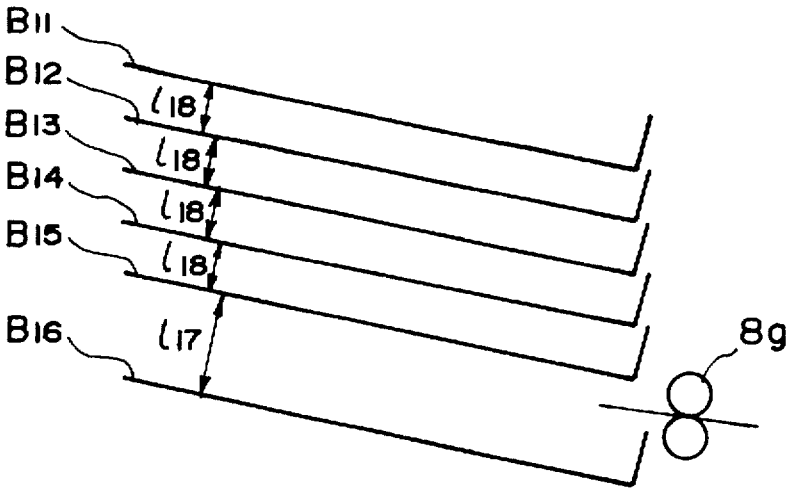
FIG. 6 is a schematic view depicting the bin movement.

Next, referring to FIG. 5(*a*), a description will be given as to the bin intervals. FIG. 5(*a*) and 5(*b*) depicts he top bin module B1, wherein the second bin B12 from the top is disposed at a location correspondent to the discharge roller-pair 8*g* and receives the discharged sheet, whereas the fourth bin B14 from the top is disposed at the sheet set transfer location, to which he bins are sequentially shifted to transfer the sheet set after the completion of the sheet delivery to the bin module. In FIG. 5(*a*), the bin intervals among the bins B11–B15 are 117, which is relatively large, and only the bin interval between the bins 15 and B16 is 118, which is relatively small, but the bin interval varies depending on the operational situation. For example, in FIG. 6, the bin B16 is at the sheet receiving position, with the bins having been moved to the uppermost position, and at this time, the bin intervals among the bins B11–B16 are 118, being relatively mall, and only the interval between the bins B15 and B16 is 117, being relatively large.

Figure 7:
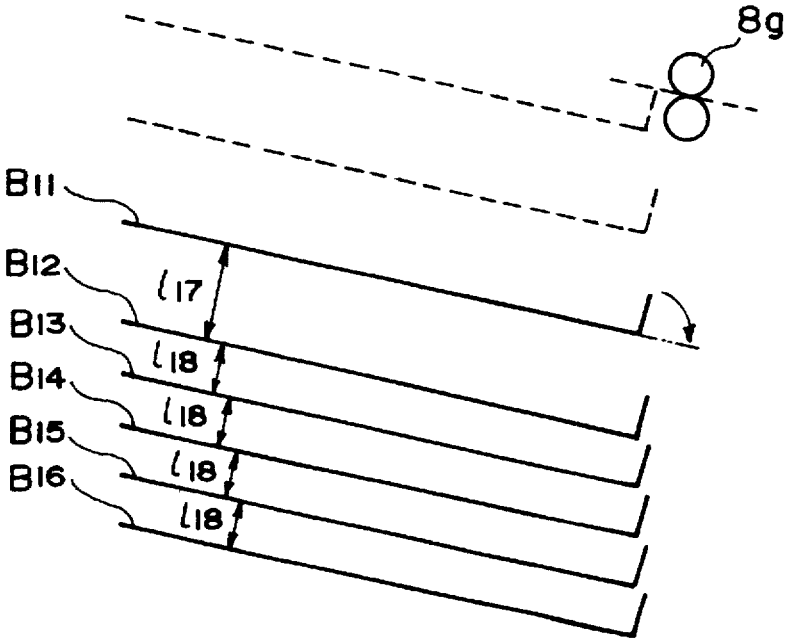
FIG. 7 is a schematic view depicting the bin movement.

In FIG. 7, the bin 11 is at the sheet set transfer position, with he bins having moved to the bottommost position, and at this time, only the interval between the bins B11 and B12 is 117, being relatively large, with others being relatively small 18. In other words, the interval between the bin at the sheet receiving position and the bin directly above needs to be approximately 117, and also the intervals between the bin at the sheet set transfer position and the bins directly above and below need to be approximately 117, that is, the intervals between bins B11 and B12, between B13 and B14, and between B14 and B15, in FIGS. 5(*a*) and 5(*b*). In FIGS. 5(*a*) and 5(*b*), the interval between bins B12 and B13 is also relatively large. Functionally, however, this interval may be as small as 118, and the size of this interval is determined depending on the relationship between the space occupied by the upper half of the stapler 11 and the bin interval.

On the other hand, in the case of the bottom bin module, the relation between the sheet receiving position and sheet set transfer position is opposite to the one in the top module as is evident from the FIG. 1 and 2. Therefore, following the same chain of thought, in FIG. 2, the interval between the bins B24 at the sheet receiving position and bins B23 directly above needs to be approximately 117, being relatively large, and the intervals between the bin B22 at the sheet set transfer position and the bins B21 and B23 directly above and below, respectively, also need to be approximately 117, whereas the interval between the bins B24 and B25 does need not be as large as 117.

However, when the interval between the bins B24 and B25 is also increased to approximately 117, the bin interval arrangement becomes identical for the top and bottom bin modules, admitting that the relation between the sheet receiving position and sheet set transfer position is reversal; in other words, the lead cam pitch that determines the bin interval may be the same for the top and bottom bin modules, which has merits in that identical lead cams can be can be used for the top and bottom bin modules. Further, there is another merit offered by the reversal arrangement of the Sheet receiving position and sheet set transfer position between the top and bottom bin modules, that is, the same gripping-stapling unit 9 and stacking unit 13 can be shared by the top and bottom bin module when the sheet is taken out.

Next, the bin shifting mechanism and its operation will be described (FIGS. 4 and 5).

The driving force from a bin shift motor M1 is synchronously transmitted to the lead cams 16*a*–16*c* by way of a motor pulley 18, a belt 19 and lead cam pulley 20*a*–20*c*, wherein as the lead cam is rotated one rotation by the forward or backward rotation of the motor M1, the bins are vertically shifted by a distance equivalent to the cam pitch. Each lead can is rotatively supported by its own bearing, and receives the driving force through the pulley 20 attached thereto, at the end opposite to the bearing. The bin shift motor 17 has an encoder 21 disposed on the side opposite to the pulley 18, and the number of rotations is detected by a sensor S1.

Each bin module ha a home position detecting sensor S2 (unillustrated), which determines whether or not the uppermost bins B11 or B21 of the top or bottom bin module, respectively, is at the correspondent sheet receiving position. Each bin module also has a penetration type sensor S3 (FIG. 2) for detecting the sheet on the bin, and the signal from this sensor is used for determining the timing for switching the modules or the like purpose.

Figure 8:
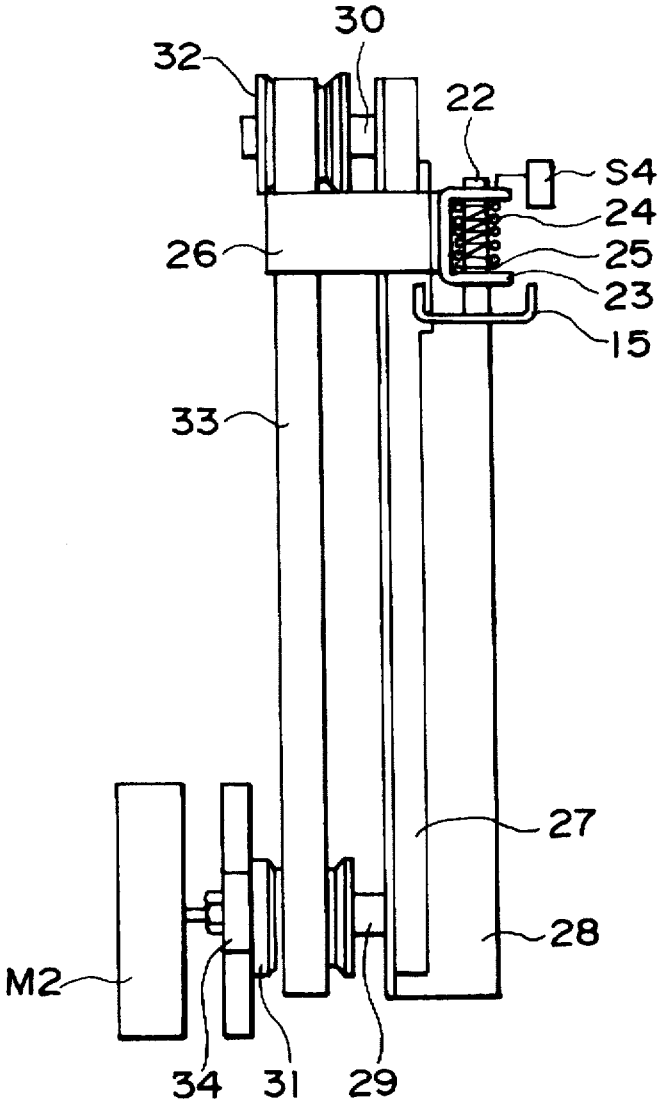
FIG. 8 is a plan view of the aligning wall driving portion of the bin module.
Figure 9:
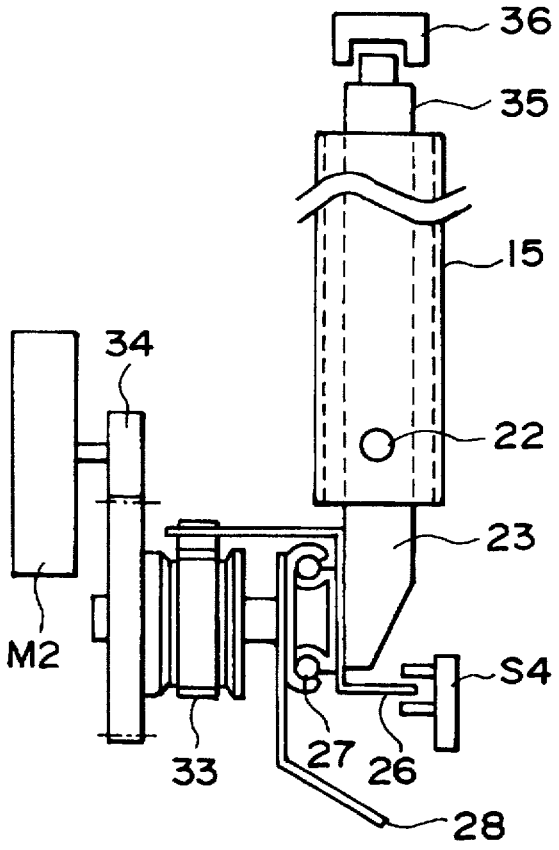
FIG. 9 is a side view of the aligning wall driving portion of the bin module.

Next, the driving mechanism for the aligning wall that aligns the sheet on the bin, referring to FIG. 8, a plan view, and FIG. 9, a front view, will be described.

The aligning wall 15 has a shaft 22, which is put through a U-shaped supporting plate 23 and attached to the aligning wall by crimping. In the inner side of the U-shaped plate 23, a compression spring 24 is placed in a state of being slightly compressed, wherein one end of it presses on the inner wall of the plate 23 and the other end abuts on a stopper 25 of the crimped shaft 22. With this arrangement, the crimped shaft 22 and aligning wall 15 are under the downward pressure generated by the compression spring.

The bottom side of the U-shaped supporting plate 23 is fixed to the moving side of the accuride 27, with the use of a slide plate 26. The fixed side of the accuride is fixed to an accuride rail plate 28 which extends in the sliding direction of the aligning rod. On the accuride rail plate 27, a front shaft 29 and a rear haft 30 are erected by crimping, and a pulley gear 31 and a pulley 32 are rotatively mounted thereto, respectively. Around the pulleys 31 and 32, a timing belt 33 is stretched, and the slide plate 26 is fixed to the belt 33. The driving force is transmitted as the motor gear of an aligning wall driving motor M2 engages with the gear portion of the pulley gear 31.

The home position of the aligning wall is detected by a sensor S4. Above the U-shaded supporting plate 23, a slide member 35 is attached, which fits in the groove of a fixed raid 36, being guided thereby. Referring to FIG. 9, the driving force is transmitted from underneath the aligning wall 15, and the upper portion is guided by the rail, but this arrangement may be vertically reversed. Further, the aligning wall structure and the power transmission thereto may be reversed between the top and bottom modules.

Next, referring to FIG. 10, 11 and 12(*a*) and 12(*b*), a guide member will be described regarding its structure, and its operation during the accumulation of folded sheets, wherein FIG. 11 is a front view; FIG. 10 is a side view seen from the direction indicated by an arrow B n FIG. 11; and FIG. 12 is a schematic drawing depicting the operation.

Referring to FIG. 11, a guide unit 37 occupies a space approximately equivalent to the bin interval. In the guide unit 37, a guide moving motor M3 is mounted on a U-shaped base 38, and as a motor gear 39 is rotated by the motor M3, the driving force is transmitted, through gears 40 and 41, to the threaded shaft 43 serving as the shaft of a guide 42 for folded paper. The folded sheet guide 42 is a member having a configuration illustrated in FIG. 10. It comprises a guiding portion 42*a* and a stopper portion 42*b*, and is engaged with the threaded shaft 43, wherein the guiding portion 42*a* and stopper portion 42*b* are on the opposite side of each other relative to the rotational center of the folded sheet guide 42. Referring to FIG. 10, the folded sheet guide 42 is moved about the threaded shaft 43 approximately 90° between a retracted position indicated by a double dot chain line and a sheet guiding position indicated by a solid line.

When the folded sheet guide 42 is rotated clockwise, a stopper portion 42*b* comes in contact with a stopper pin 44 projecting from the base 38, and when it is rotated counterclockwise, the guide portion 42 comes in contact with the stopper pin 44. The hole of the folded sheet guide 42, through which the threaded shaft 43 is put, is also threaded to be meshed with the threaded shaft 43. When the folded sheet guide 42 is not in contact with the stopper pin 44, it rotates with the threaded shaft 43 until it comes in contact with the stopper pin 44. However, as the threaded shaft 43 is further rotated after the guide 42 contacts the shopper bin 44, the guide 42 this time is moved in the direction of arrow mark C in FIG. 11, remaining in contact with the stopper pin 44.

In other words, referring first to FIG. 10, as the motor M3 is rotated forward, the folded sheet guide 42 at the retracted position indicated by the double dot chain line is moved clockwise to the receiving position indicated by the solid line, and referring next to FIG. 11, as the motor M3 is further rotated, it is lowered from a solid line position to a broken line position, where the rotational direction of the motor M3 is reversed. Then, the folded sheet guide 42 is rotated counterclockwise from the receiving position indicated by the solid line in FIG. 10 to the retracted position indicated by the double dot line in FIG. 10, and as the motor M3 is further rotated, it is raised from the broken line position to the solid line position in FIG. 11.

The function of the folded sheet guide 42 will be described referring to FIGS. 12(*a*) and 12(*b*).

The folded portion Q of a Z-folded sheet Sz having been accumulated on a bin B is located at an approximately middle portion of the bin relative to the sheet delivery direction; therefore, when the next folded sheet Sn is discharged, its leading end might collide with the folded portion Q as illustrated in FIG. 12(*b*), which might disturb the accumulated sheets. However, in this embodiment, the folded sheet guide 42 is moved above the folded portion Q and is extended over the sheet; therefore, the leading end of the next folded sheet Sn can be guided by the folded sheet guide 42 so as not to disturb the accumulated sheets. After the next sheet Sn is deposited, the folded sheet guide is prepared for the next folded sheet. First, it is rotated in parallel to the sheet accumulating surface in order to move it out of the sheet delivery path, and then, is raised above the highest point of the last accumulated folded sheet. Next, it is dispatched over the accumulated sheets, and then, is lowered to a predetermined level.

As the number of the accumulated folded sheets increases, the highest portion of the topmost one of the accumulated folded sheets comes in contact with the bottom surface of the folded sheet guide. This state of contact is permissible to a certain point. In other words, there may be a slight gap between the bottom surface of the folded sheet guide 42 and the highest point of the topmost one of the accumulated folded sheets, or both may be in contact, with a gentle contact pressure. As for the width of the guide member 42 (length 11 in FIG. 12(*a*), it is preferable for the guide member 42 to be wide enough to cover the folded portion regardless of the folded sheet size so that the folded sheet of different type or size can be dealt with by a single guide member. Needless to say, the wider guiding width may be provided by a plurality of guides.

As for the guide member depth (length 12 in FIG. 10), it is referable to be as long as possible. This is because when the following discharged folded sheet can he guided across the entire length of the folded portion of the previously discharged sheet, there will be no chance that the following folded sheet collides with the folded portion of the preceding sheet. However, when the requirement for the guide retraction and overall size of the apparatus are taken into consideration, it is preferable for the guide member size to be as small as possible. According to experiments, the guiding member can effectively function as long as a distance from the edge of the discharged folded sheet (13 in FIG. 10) is 15 mm or so. Therefore, when two guiding members are provided, one at the front and another at the rear, so that the following sheet is guided by the width of approximately 15 mm from the sheet edge, at the front and rear, the folded sheet can be more smoothly accumulated.

Next, the configuration of the guide 42 will be described.

Referring to FIG. 10, an upstream side edge 42*c* of the guide 42 relative to the sheet delivery direction is angled as shown in the drawing; in other words, he guide 42 is tapered in toward the sheet edge. Normally, the edge 42*c* is on the upstream side of the landing spot of the leading end of the following sheet, wherein even when the leading end lands close to the edge 42 due to an abnormal situation such as an occurrence of unusual curling, this slant of the edge 42 reduces the possibility that the edge 42*c* hooks the leading end of the sheet.

As for the thickness of the guide 42, its thickness is reduced toward the upstream side of the sheet delivery direction, as is depicted by the sectional view of the raised guide 42 in FIG. 11 (solid line). In other words, its thickness is smallest at the edge 42*c*, the most upstream portion. Therefore, the interval between the bins can be most efficiently used to accumulate the folded sheet.

Referring again to FIG. 11, an upper limit switch S5 and a lower limit switch S6 are mounted on the base 38 in order to detect the raised and lowered positions of the guide 42*a*, respectively, and the rotational direction of the motor M3 is reversed when these switches are activated.

Figure 13:
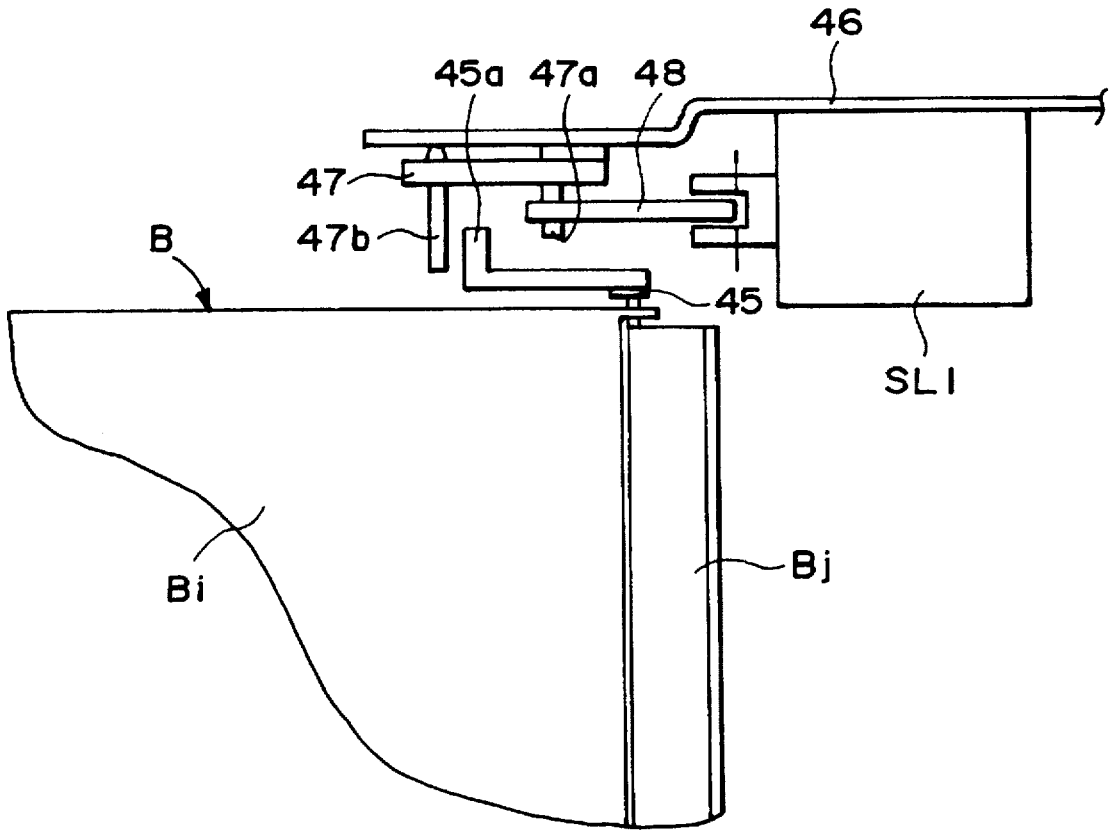
FIG. 13 is a plan view of a driving section for driving the upright portion of the bin tray.
Figure 14:
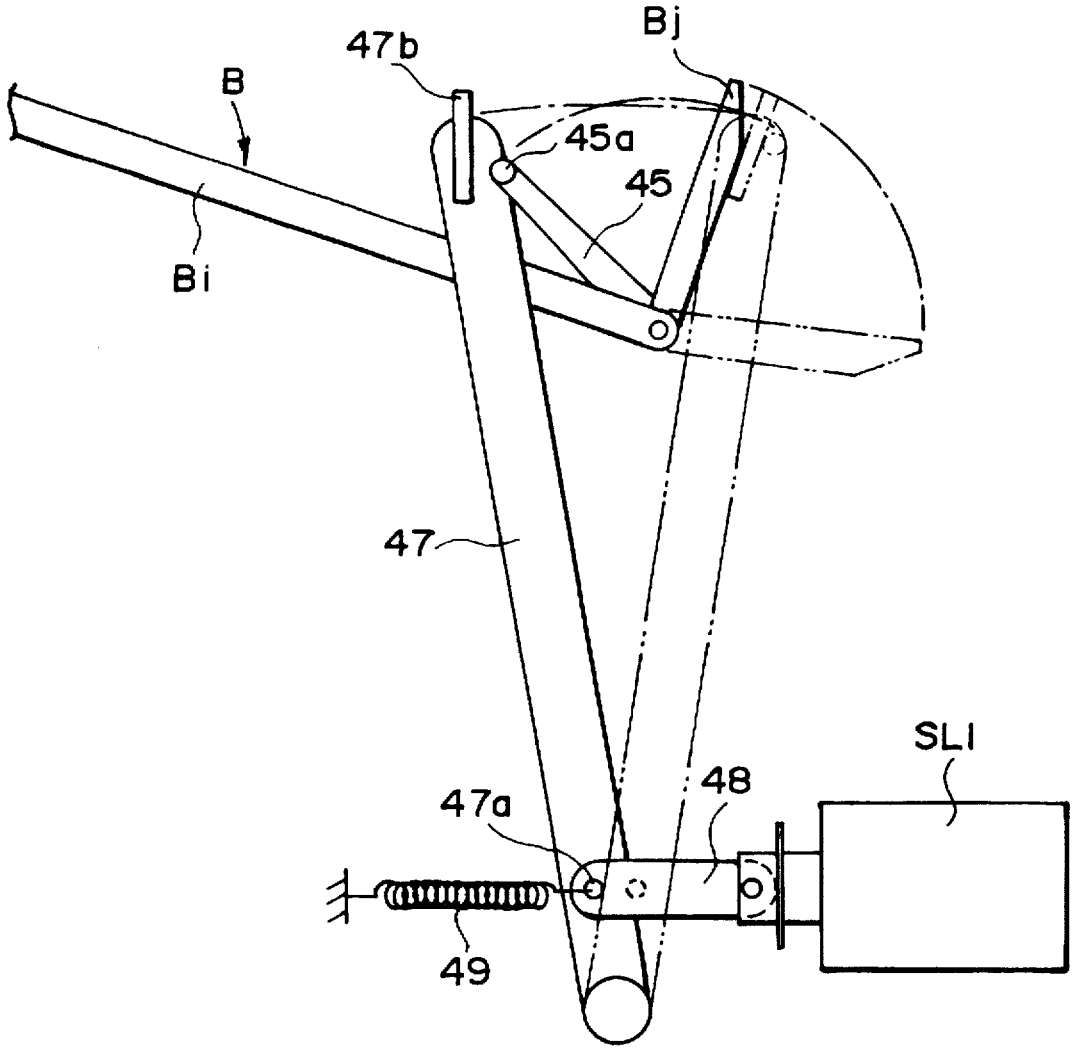
FIG. 14 is a side view of the driving section for driving the upright portion of the bin tray.

Next, the driving mechanism for the upright portion of the bin will be described. This upright portion of the bin serves as the aligning surface relative to the sheet delivery direction (FIGS. 13 and 14).

This driving mechanism moves the upright portion of the bin when the sheet set accumulated on the bin must be moved past the location of the upright portion of the bin in order to process or stack it. FIG. 13 is a plan viewer and FIG. 14 is a front view.

The bin B comprises a sheet accumulating portion B and a aligning portion Bj, wherein the rotational axis of the aligning portion Bj is rotatively fitted in the hole on the accumulating portion Bi side. As for the rotational angle, it is approximately 90° as illustrated in FIG. 14; in other words, the aligning surface perpendicular to the fixed accumulating surface can be rotated to become substantially level with the accumulating surface. Normally, the aligning portion Bj is placed under the pressure from a spring or the like so that the accumulating surface and aligning surface remain perpendicular to each other (solid line in FIG. 14). The spring is strong enough to prevent the aligning portion Bj from being pushed down by the weight of the sheet set on the bin. Further, on the rear side of the aligning portion Bj, a driving arm 45 is attached, and a pin 45*a* is erected from the free end of the driving arm.

A solenoid SL1 for driving the upright portion Of the bin is supported on a base 46. On the base 46, a link 47 is rotatively supported, and one end of an arm 48 is engaged with the pin 47*a* of the link 47. The other end of the arm 48 is attached to the solenoid SL1, and the link 47 is moved from a solid line position to a double dot chain line position by the solenoid activation. At the free end portion of the link 47, contact member 47*b* is attached, wherein normally, there is a sufficient gap between the contact member 47*b* and the pin 45*a*, so that the vertical movement of the bin B is not interfered with. When the sheet set is stacked after the completion of the sheet discharge onto the bin and the subsequent processing of the sheet set in the bin, the involved bin is shifted to a position illustrated in FIG. 14, and then, the solenoid SL1 is activated. The bin contact member 47*b* comes in contact with the pin 45*b*, and the link 47 further rotates, and the aligning portion Bj is moved to the double dot chain line position in FIG. 14. When the solenoid SL1 is deactivated, the link 47 returns to the solid line position by the function of a spring 49, allowing thereby the aligning portion Bj to return to the position where it becomes perpendicular to the sheet accumulating surface.

Figure 23:
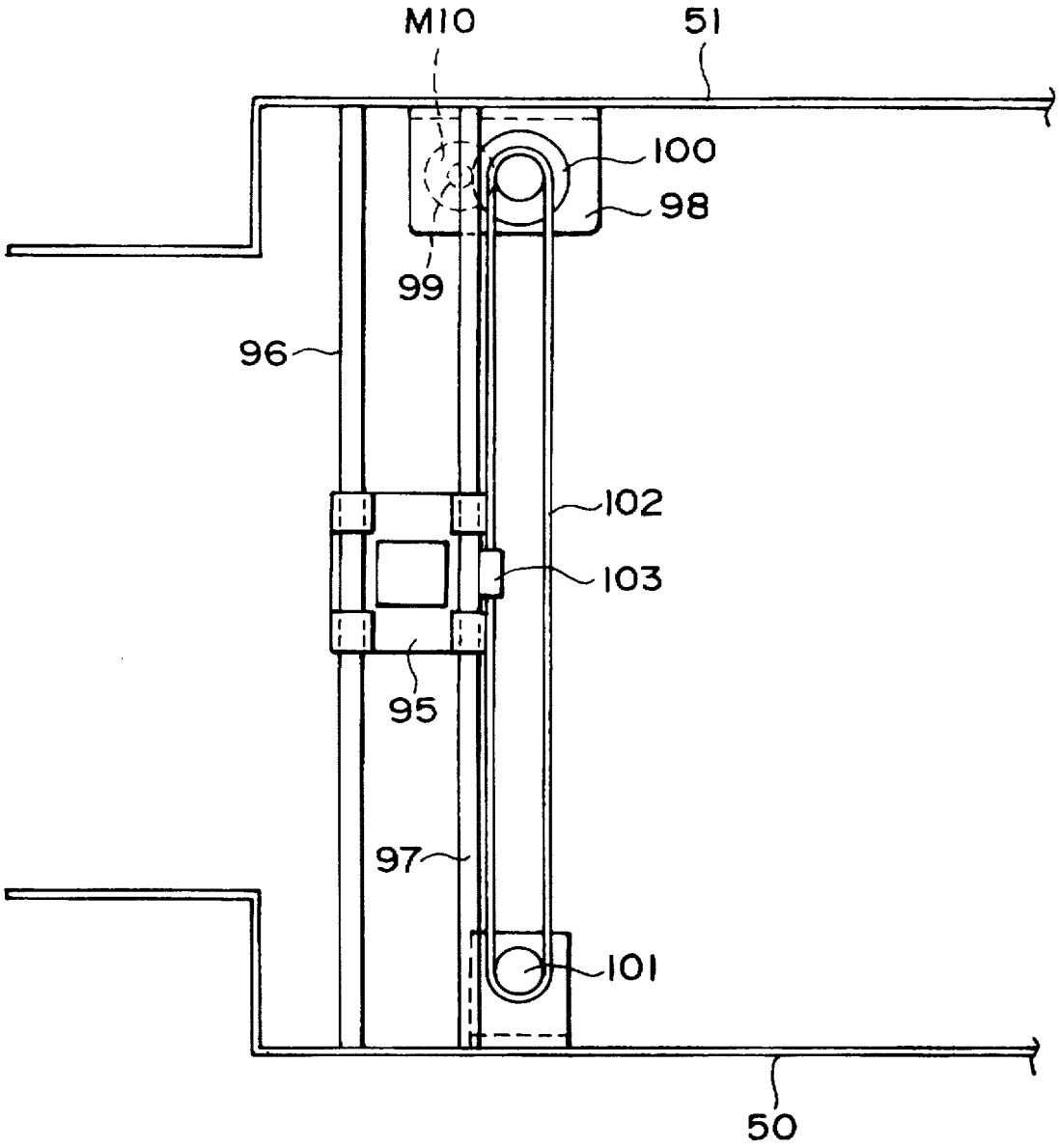
FIG. 23 is a plan view of the stapling unit driving portion of the bin module.

Next referring to FIG. 22, a side view, and FIG. 23, a plan view, how the stapler 11 is driven forward or backward will be described.

Referring to FIG. 22, the stapler 11 is fixed on the base 94. On the upper portion of the base 94, a slider 95 is attached. The slider 95 has four bearing portions through which two axes 96 and 97 are put, wherein the staler 11 is supported by two axes 96 and 97, hanging from them, which are bridged between the front and rear plate 50 and 51 of the unit. A motor M10 for moving the stapler 11 in the forward or backward direction is mounted on a motor mount 98, which is fixed to the rear plate 51. The driving force of the motor M10 is transmitted to the stapling unit through a motor gear 99, a motor pulley 100, a follower pulley, a belt 102 stretched between the pulleys, and the slider 95 fixed to the belt 102 using a regulating member 103, whereby the stapling unit can be moved in the direction of an arrow J in FIG. 22. The stapling unit can be stopped at any location between retracted position 11*a* in front and a retracted position 11*b* in the rear. The position of the stapling unit is detected by a position sensor S11 in front and a position sensor S12 in the rear, and the moving distance is detected by a sensor S13 that reads the encoder of the motor M10, whereby the stapling unit is positioned at a predetermined location.

Next, the structure of the stacking unit 13 will be described with reference to FIGS. 24, a plan view, FIG. 26, a front view of the frame portion of the stacking unit, and FIG. 27, a side view.

Figure 24:
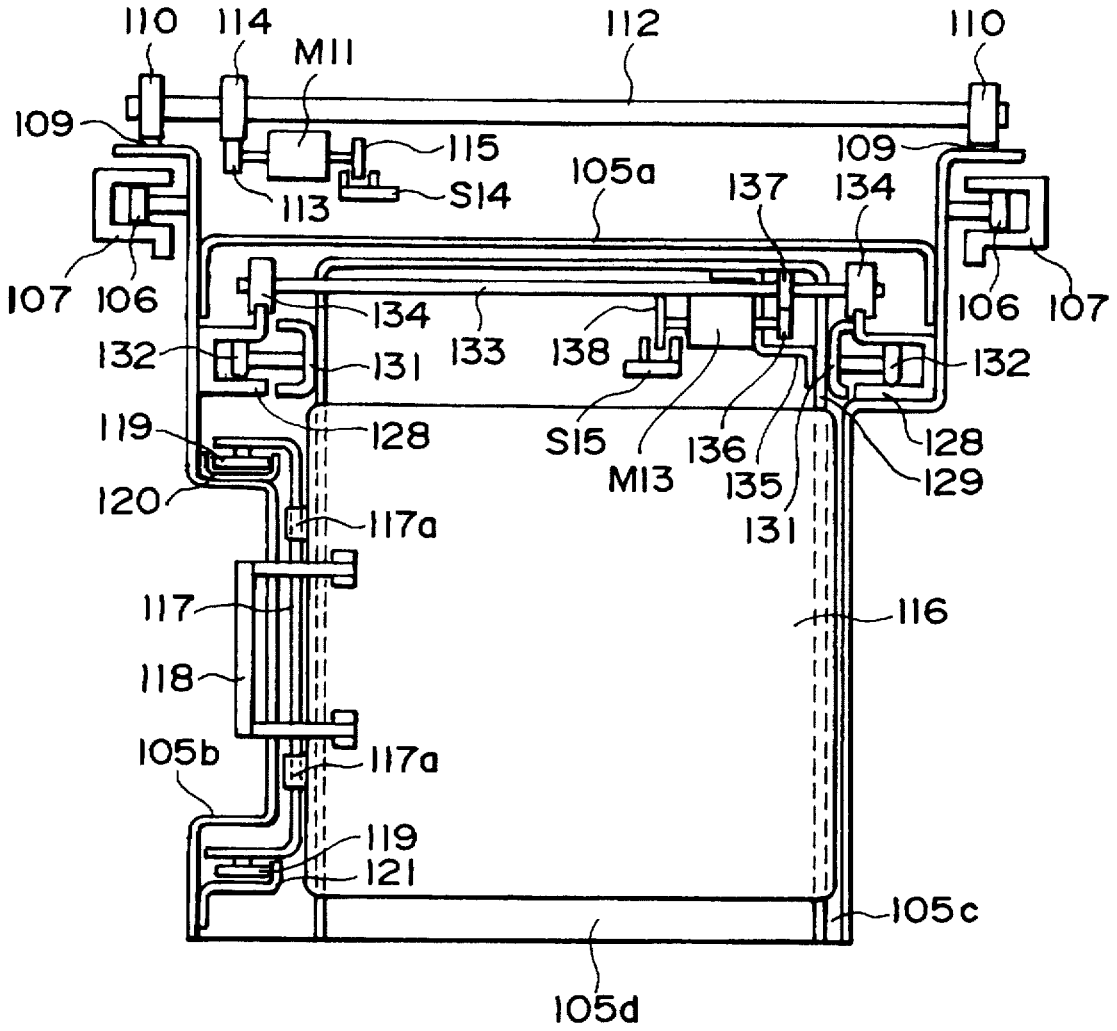
FIG. 24 is a plan view of the stacking unit of the bin module.

First, referring to FIG. 24, a frame 105, which serves as the outer frame of the stacking unit 13, is constituted of four section: a rear plate 105*a*, a left plate 105*b*, a right plate 105*c*, and a bottom pate 105*d*. On the exterior surface of the left plate 105*b* and that of the right plate 105*c*, two rollers 106 for vertical movement are attached (total of four rollers), on the rear side, and these rollers 106 are guided by a rail 107 fixed to he main frame apparatus. It should be noted here that this raid 107 may be the very rail of the gripping-stapling unit 9 illustrated in FIG. 15; in other words, the same rail may be shared by the stacking unit 13 and gripping-sapling unit 9.

Figure 27:
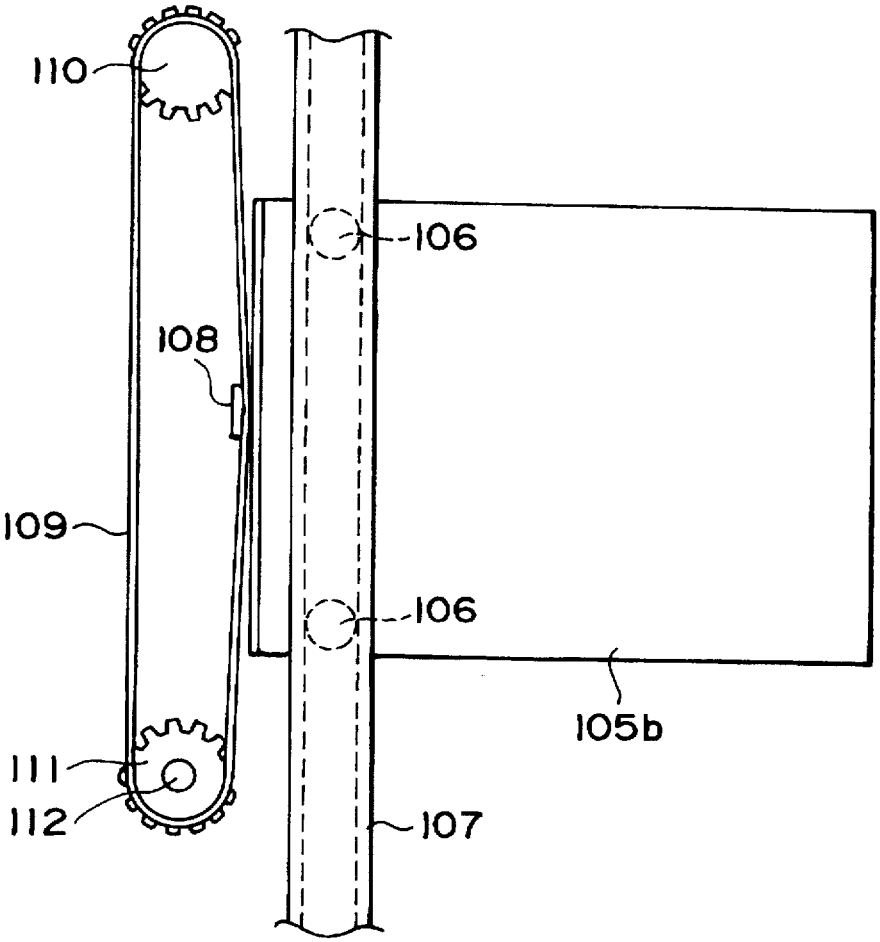
FIG. 27 is the left side view of the stacking unit driving portion illustrated in FIG. 15.

In FIGS. 24 and 27, a chain 109 is fixed to the bent portion of the left plate 105*b* and another chain 106 is fixed to the bent portion of the right plate 105*c*, wherein the left and right chains are stretched between correspondent top an bottom sprockets 110 and 111. The bottom sprockets are connected with a through axis 112, wherein a motor M11 for moving vertically the stacker frame is mounted on the main frame of the apparatus, and the driving force from the motor M11 is transmitted to the through axis 112 by way of gears 113 and 114, whereby the frame can be vertically moved.

As for the locations where the frame is stopped, in addition to two locations correspondent to two stopping locations of the gripping-stapling unit 9 illustrated in FIG. 2 (broken line above, and solid line below), more locations are set, for example, a location at which the stacker tray can be pulled out, which will be described later, a location at which the stacking unit is stopped for changing the stacking height limit, and the like location. Normally, the home position of the stacking unit is the position correspondent to the top bin module. Returning to FIG. 24, the stacking unit 13 can be stopped at the aforementioned various locations by reading the encoder 115 of the motor M11 with the use of sensor S14.

On the left plate 105*b* of the stacker frame, a stacking reference wall 117, which serves as a reference wall for the sheet sets on he sacking tray 116, is supported so as to be moved vertically, and also, a pressing member 18 is supported, which holds down the sheet sets on the stacking tray 116 from above.

Normally, the stacking reference wall 117 is positioned at the bottommost level, and is moved upward when the stacking height limit is changed, which will be described later.

As for he mechanism for moving vertically the stacking unit, referring to FIG. 24, a total of four rollers 119, two in front and two in the rear, are mounted on the reference wall, and these rollers 119 are guided by correspondent rails 120 and 121 fixed to the left plate 105*b* of the stacker frame, making it possible to move vertically the reference wall. The driving force comes from an unillustrated motor M12 for moving vertically the reference wall. Also referring to FIGS. 24 and 26, a guide roller 117*a* is rotatively attached to the reference wall 117 so that the trailing end of the sheet set does not get stuck on the slanted surface formed at the top portion of the reference wall 117.

Further, a proximity sensor S16 is provided on the top end of the reference wall, which detects the distance between the stacking unit and the gripping-stapling unit above, so that when two units approach closer than a predetermined distance, the driving force in the approaching direction is stopped to avoid collision. Further, on the lateral surface of the reference wall, a stack height sensor S17 is mounted, which detects the topmost sheet of the accumulated sheet sets to control the vertical position of the stacking tray 116 or the like.

Figure 28:
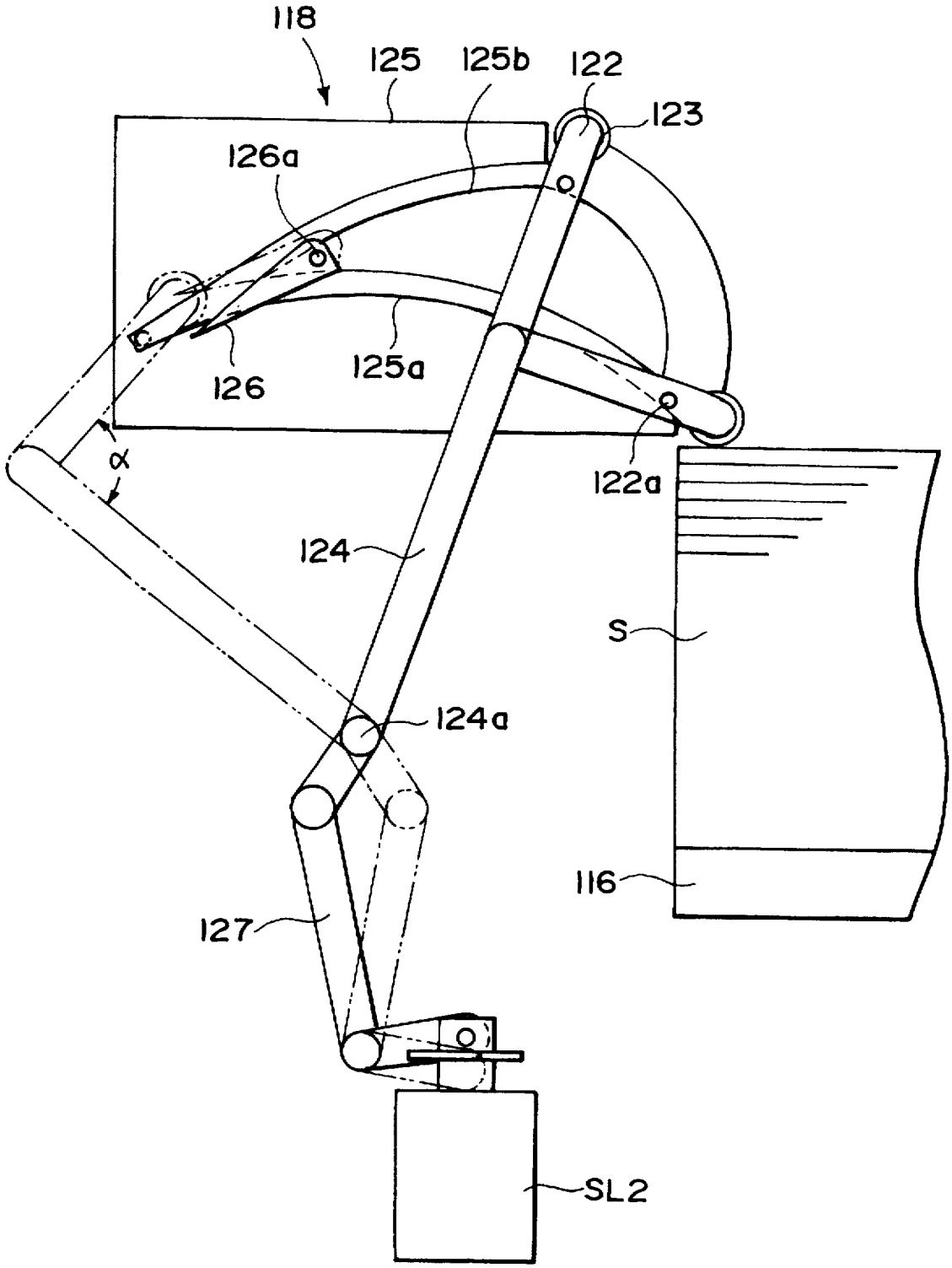
FIG. 28 is a front view of the stack holding member of the bin module.

Next, the pressing member 118 will be described with reference to FIG. 28.

The pressing member 118 hold down the sheet set S on the stacking tray 116 in order to serve two purposes, that is, to prevent the sheets of the sheet sets having been already accumulated on the stacking tray 116 from being disturbed by the sheet set being stacked on the stacking tray, as well as to prevent the sheets of a sheet set being transferred, from being shifted by the shock generated as the sheet set drops on the stacking tray.

Next, the stacking tray 116 will be described referring to FIG. 24, and FIG. 25, which is a front view of the front portion of the stacking tray and its adjacencies.

The stacking tray 116 is fitted within the aforementioned stacker frame 105, and is controlled to descend gradually so that the uppermost surface of the sheet set stack remains at a predetermined level.

Figure 25:
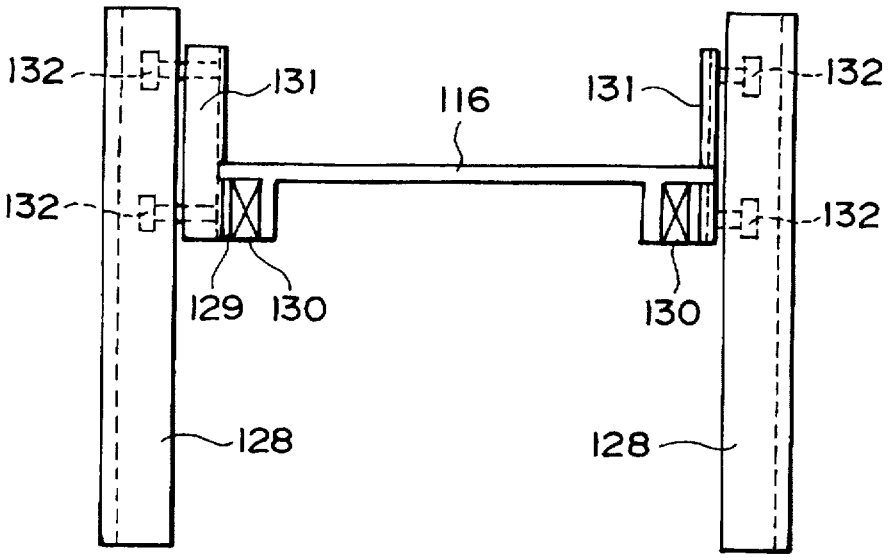
FIG. 25 is a front view of the stacking tray of the bin module.

Referring to FIGS. 24 and 25, reference numerals 128 and 128 designate rails, which are fixed to correspondent side plates. The stacking tray 116 rests on an ACCURIDE 130, and can be pulled out of a stacker tray base 129 toward the front. On the outward facing left and right surfaces of the stacking tray base, a U-shaped roller mounting plate 131 is attached, to which two rollers 132 are mounted by crimping. These rollers 132 re guided by the rail 128. At one end of the rail 128, a vertical rack is provided, which meshes with a pinion gear 134 mounted at each end of an axis 133, which is horizontally put through the base 129. A motor M13 for moving vertically the stacking tray is mounted on the stacking tray base 129 with the use of a motor mount 135, and the driving force from the motor M13 is transmitted to the axis 133 through gears 136 and 137. The descending distance of the stacking tray is controlled by reading an encoder attached to the other end of the motor M13 with the use of sensor S15.

Next, a description will be given as to the driving mechanism of the sheet delivery system (FIG. 29). FIG. 29 is a schematic view of the driving mechanism. The hatched roller of each roller pair is the driving side and the other is the follower side. Roughly speaking, the driving system can be divided into three sub-systems.

First, a sheet delivery motor M14 is in charge of the sub-system closer to the main assembly of the copying apparatus, and delivers its force to the vertical delivery path and non-sort delivery path that come after the path branches into the delivery path to the top Din module and delivery path to the bottom module. There are seven roller pairs involved in this sub-system: roller pairs **8*a*–8*c*, and 8*h*–8*k***.

Next, a sheet delivery motor M15 takes care of the horizontal path for the top bin module, and delivers it driving force to four roller pairs **8*d*–8*h***.

While the invention has been described with reference to the structures disclosed herein, it is not confined to the details set forth and this application is intended to cover such modifications or changes as may come within the purposes of the improvements or the scope of the following claims.

What is claimed is:

1. A sheet processing apparatus, comprising:

tray means for stacking a folded or non-folded sheet;

stacking means for receiving the folded sheet or non-folded sheet from said tray means to stack it thereon;

transfer means for transferring the folded sheet or non-folded sheet from said tray means to said stacking means; and control means for controlling speed of said transferring means so as to satisfy:

$$V1<V2$$

where V1 is a transfer speed for the folded sheet, and V2 is a transfer speed of the non-folded sheet.

2. An apparatus according to claim 1, wherein said transfer means transfers a set of the sheets.

3. An apparatus according to claim 1, wherein said transfer means transfers a set of the sheets, and said control means controls the speed at V1 when mixed folded and non-folded sheets are transferred.

4. An apparatus according to claim 1, wherein said transfer means transfers a set of the sheets, and said control means controls the seed at V1 if mixed folded and non-folded sheets are transferred, and a topmost sheet is a folded sheet.

5. An apparatus according to claim 4, wherein if the topmost sheet is a non-folded sheet, said control means controls the speed at V2.

6. An apparatus according to claim 1, further comprising sheet folding means upstream of said tray, and said folding means includes a sheet folding portion and a through path for passing the sheet without folding.

7. An apparatus according to claim 1, wherein said tray means contains a plurality of bin trays arranged substantially vertically.

8. An apparatus according to claim 2, further comprising binding means for binding a set of the sheets, and said transfer means transfers the set of sheets bound by said binding means.

9. An apparatus according to claim 8, further comprising gripping means for pulling a set of the sheets to said binding means.

10. An apparatus according to claim 9, wherein said binding means and said stacking means are disposed upstream of said tray.

11. An apparatus according to claim 1, wherein said transfer means grips an end of a set of the sheets, and is supported for movement in a direction substantially parallel with a sheet movement direction, and movement thereof is controlled by a rotational motor and a belt, wherein the speed is controlled by changing a rotational speed of said motor.

12. An apparatus according to claim 1, wherein an acceleration of the speed V1 is smaller than an acceleration of the speed V2.

13. A sheet processing apparatus, comprising:

moving means for moving a folded sheet or non-folded sheet; and control means for controlling speed of said moving means so as to satisfy:

$$V1<V2$$

where V1 is a moving speed for the folded sheet, and V2 is a moving speed of the non-folded sheet.

14. An apparatus according to claim 13, wherein said moving means moves a set of the sheets, and said control means controls the speed at V1 when mixed folded and non-folded sheets are moved.

15. An apparatus according to claim 13, wherein said moving means moves a set of the sheets, and said control means controls the speed at V1 if mixed folded and non-folded sheets are moved, and a topmost sheet is a folded sheet.

16. An apparatus according to claim 15, wherein if the topmost sheet is a non-folded sheet, said control means controls the speed at V2.

* * * * *

UNITED STATES PATENT AND TRADEMARK OFFICE

CERTIFICATE OF CORRECTION

PATENT NO. : 5,735,515

DATED : April 7, 1998

INVENTOR(S) : HAYASHI ET AL.

It is certified that error appears in the above-indentified patent and that said Letters Patent is hereby corrected as shown below:

Column 1

Line 67, "he" should read --the--.

Column 4

Line 14, "c-folding" should read --C-folding--.
Line 18, "he" should read --the--.
Line 46, "he" should read --the--.

Column 5

Line 57, "pas" should read --pass--.

Column 7

Line 18, "optional, therefore," should read --optional. Therefore,--.
Line 29, "grip ping" should read --gripping--.
Line 49, "an" should read --and--.

Column 9

Line 66, "he" should read --the--.

Column 10

Line 66, "he" should read --the--.

Column 11

Line 35, "o" should read --to--.

UNITED STATES PATENT AND TRADEMARK OFFICE

CERTIFICATE OF CORRECTION

PATENT NO. : 5,735,515

DATED : April 7, 1998

INVENTOR(S) : HAYASHI ET AL.

It is certified that error appears in the above-indentified patent and that said Letters Patent is hereby corrected as shown below:

Column 12

Line 54, "go" should read --to--.

Column 13

Line 40, "described," should read --described.--.

Column 14

Line 66, "he" should read --the--.

Column 16

Line 1, "se" should read --set--.
Line 8, "th" should read --the--.
Line 46, "vertically the bins," should read --the bins vertically,--.
Line 66, "he" should read --the--.

Column 17

Line 31, "FIG." should read --FIGS.--; and "he" should read --the--.
Line 49, "he" should read --the--.
Line 67, "FIG." should read --FIGS.--.

Column 18

Line 17, "can be" should be deleted.
Line 19, "Sheet" should read --sheet--.
Line 38, "ha" should read --has--.
Line 63, "haft" should read --shaft--.

UNITED STATES PATENT AND TRADEMARK OFFICE

CERTIFICATE OF CORRECTION

PATENT NO. : 5,735,515

DATED : April 7, 1998

INVENTOR(S) : HAYASHI ET AL.

It is certified that error appears in the above-indentified patent and that said Letters Patent is hereby corrected as shown below:

Column 19

Line 6, "raid" should read --rail--.
Line 12, "FIG." should read --FIGS.--.
Line 16, "n" should read --in--.

Column 20

Line 29, "referable" should read --preferable--.
Line 30, "he" should read --be--.
Line 48, "he" should read --the--.

Column 21

Line 11, "a" should read --an--.
Line 26, "Of" should read --of--.
Line 54, "staler 11" should read --stapler 11--.

Column 22

Line 16, "he main frame" should read --the main frame of the--.
Line 19, "sapling" should read --stapling--.
Line 24, "an" should read --and--.
Line 46, "he sacking" should read --the stacking--.
Line 54, "he" should read --the--.

UNITED STATES PATENT AND TRADEMARK OFFICE

CERTIFICATE OF CORRECTION

PATENT NO. : 5,735,515 Page 4 of 4

DATED : April 7, 1998

INVENTOR(S) : HAYASHI ET AL.

It is certified that error appears in the above-indentified patent and that said Letters Patent is hereby corrected as shown below:

Column 23

Line 11, "hold" should read --holds--.
Line 33, "re" should read --are--.
Line 54, "Din" should read --bin--.

Signed and Sealed this

Twenty-fourth Day of November, 1998

*Attest:*

Bruce Lehman

BRUCE LEHMAN

*Attesting Officer*

*Commissioner of Patents and Trademarks*